US008336442B2

(12) United States Patent
Testa et al.

(10) Patent No.: US 8,336,442 B2
(45) Date of Patent: Dec. 25, 2012

(54) AUTOMATICALLY-RELOADABLE, REMOTELY-OPERATED WEAPON SYSTEM HAVING AN EXTERNALLY-POWERED FIREARM

(75) Inventors: Robert Testa, Warwick, NY (US); Michael Manuel Mera, Bangor, PA (US); William Burgermeister, Freehold, NJ (US); Brian Hoffman, Bangor, PA (US); James Lee, Randolph, NJ (US); Bai Ming Cen, Jersey City, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 446 days.

(21) Appl. No.: 12/622,355

(22) Filed: Nov. 19, 2009

(65) Prior Publication Data

US 2012/0152103 A1 Jun. 21, 2012

Related U.S. Application Data

(60) Provisional application No. 61/116,746, filed on Nov. 21, 2008, provisional application No. 61/177,797, filed on May 13, 2009.

(51) Int. Cl.
*F41A 9/00* (2006.01)

(52) U.S. Cl. ..... 89/45

(58) Field of Classification Search ..... 89/45, 41.02
See application file for complete search history.

(56) References Cited

U.S. PATENT DOCUMENTS

| | | | | | |
|---|---|---|---|---|---|
| 593,227 | A | * | 11/1897 | Maxim | 89/11 |
| 1,612,118 | A | * | 12/1926 | Willard et al. | 89/41.18 |
| 1,739,608 | A | * | 12/1929 | Oelke | 89/41.02 |
| 2,649,840 | A | * | 8/1953 | Davidson, Jr. | 89/33.16 |
| 3,417,198 | A | * | 12/1968 | Loyd | 348/150 |
| 4,092,900 | A | * | 6/1978 | Hottinger et al. | 89/33.1 |
| 7,210,392 | B2 | * | 5/2007 | Greene et al. | 89/41.03 |
| 7,509,904 | B2 | * | 3/2009 | Plumier | 89/41.05 |

* cited by examiner

*Primary Examiner* — Bret Hayes
*Assistant Examiner* — Reginald Tillman, Jr.
(74) *Attorney, Agent, or Firm* — Henry S. Goldfine

(57) ABSTRACT

An automatically-reloadable, remotely-operated weapon system may include an operator station located distant from a weapon station. The weapon station may include an externally-powered firearm, a firearm mover for adjusting an azimuth and an angle of inclination of the firearm, and an ammunition storage and transport system for automatically moving ammunition to and from the firearm. From the operator station, a user may remotely control all aspects of firearm operation and ammunition reloading.

14 Claims, 28 Drawing Sheets

AUTOMATICALLY-RELOADABLE, REMOTELY-OPERATED WEAPON SYSTEM HAVING AN EXTERNALLY-POWERED FIREARM

CROSS-REFERENCE TO RELATED APPLICATIONS

This application claims the benefit under 35 USC 119(e) of U.S. provisional patent application 61/116,746 filed on Nov. 21, 2008, and U.S. provisional patent application 61/177,797 filed on May 13, 2009, both of which are expressly incorporated by reference herein. U.S. patent application Ser. No. 12/607,393 entitled "Reciprocally-Cycled, Externally Actuated Weapon," with a filing date of Oct. 28, 2009 and the same assignee as the instant application, is expressly incorporated by reference herein.

STATEMENT OF GOVERNMENT INTEREST

The invention described herein may be manufactured, used and/or licensed by or for the U.S. Government for governmental purposes, without the payment of royalties by the U.S. Government to the inventors or any future assignees.

BACKGROUND OF THE INVENTION

The invention relates in general to remotely-operated weapons and, in particular to automatically reloadable, remotely-operated, externally-powered weapons.

Remotely-operated weapons may include a turret mounted on a vehicle, or on a fixed or mobile carriage. The turret may include a frame for supporting a firearm. The firearm may be suspended in a tilting manner in a pintle affixed to the frame. To point the firearm in the direction of a target, the turret head may be swiveled by an azimuth motor. The inclination of the firearm may be controlled by a motor that elevates the frame.

The firearm used in a remotely-operated weapon may be a conventional, human-operated firearm. The human-operated weapon may require manual feeding of ammunition into the firearm. Thus, the human operator may be at risk when operating the weapon. Also, the human-operated firearm may be commandeered and utilized by the enemy.

SUMMARY OF THE INVENTION

An object of the invention is to provide a remotely-operated weapon system that may be automatically reloaded.

Another object of the invention is to provide a remotely-operated weapon system that includes an externally-powered firearm.

A further object of the invention is to provide a payload storage and transportation system for moving objects along a linear path.

One aspect of the invention is an automatically-reloadable, remotely-operated weapon system that may include an operator station and a weapon station located distant from the operator station. The weapon station may include an externally-powered firearm, a firearm mover for adjusting an azimuth and an angle of inclination of the firearm, and an ammunition storage and transport system for automatically moving ammunition to and from the firearm. Communicators may be disposed at the operator station and the weapon station for exchanging information between the two stations.

The ammunition storage and transport system may include a transporter, a track disposed adjacent the transporter, and a storage assembly disposed adjacent the transporter. The storage assembly may include at least one retention slot disposed at a first end of the track.

Another aspect of the invention is a method that may include providing an automatically-reloadable, remotely-operated weapon system and, automatically reloading a firearm by moving a first ammunition container away from the firearm and moving a second ammunition container adjacent the firearm.

A further aspect of the invention is a transporter for moving a payload along a linear path. The transporter may include a stationary base and a first arm assembly. The first arm assembly may include a first gear coupled to the stationary base, an idler gear that meshes with the first gear, and a second gear that meshes with the idler gear. The first and second gears may include parallel axes. A gear ratio of the first gear to the second gear may be 2:1.

The transporter may include a driver for rotating the first arm assembly around the axis of the first gear. A second arm assembly may be rigidly coupled to the second gear such that rotation of the second gear rotates the second arm assembly around the axis of the second gear. The second arm assembly may include a third axis that is parallel to the axes of the first and second gears wherein a distance between the first gear axis and the second gear axis is a same distance as a distance between the second gear axis and the third axis. A payload engager may be disposed at the third axis, for engaging and disengaging the payload.

Yet another aspect of the invention is a payload storage and transport system. The payload storage and transport system may include a transporter and a storage assembly disposed adjacent the transporter. The storage assembly may include at least one retention slot disposed at a first end of a track.

The invention will be better understood, and further objects, features, and advantages of the invention will become more apparent from the following detailed description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Before describing a remotely-operable, automatically-reloadable weapon system, a novel storage and transport system will be described, with reference to FIGS. 1-19. The storage and transport system described herein may be used in a remotely-operable, automatically-reloadable weapon system. The storage and transport system may include a transporter for transporting ammunition to and from a firearm used in the remotely-operable, automatically-reloadable weapon system.

Embodiments of the transporter disclosed herein may be useful not only for transporting ammunition, but also for moving or transporting other objects along any linear path. The objects may be anything, including containers with or without contents therein. In the description of the various embodiments herein, the objects being moved or transported may be referred to as "payloads."

Figure 1:
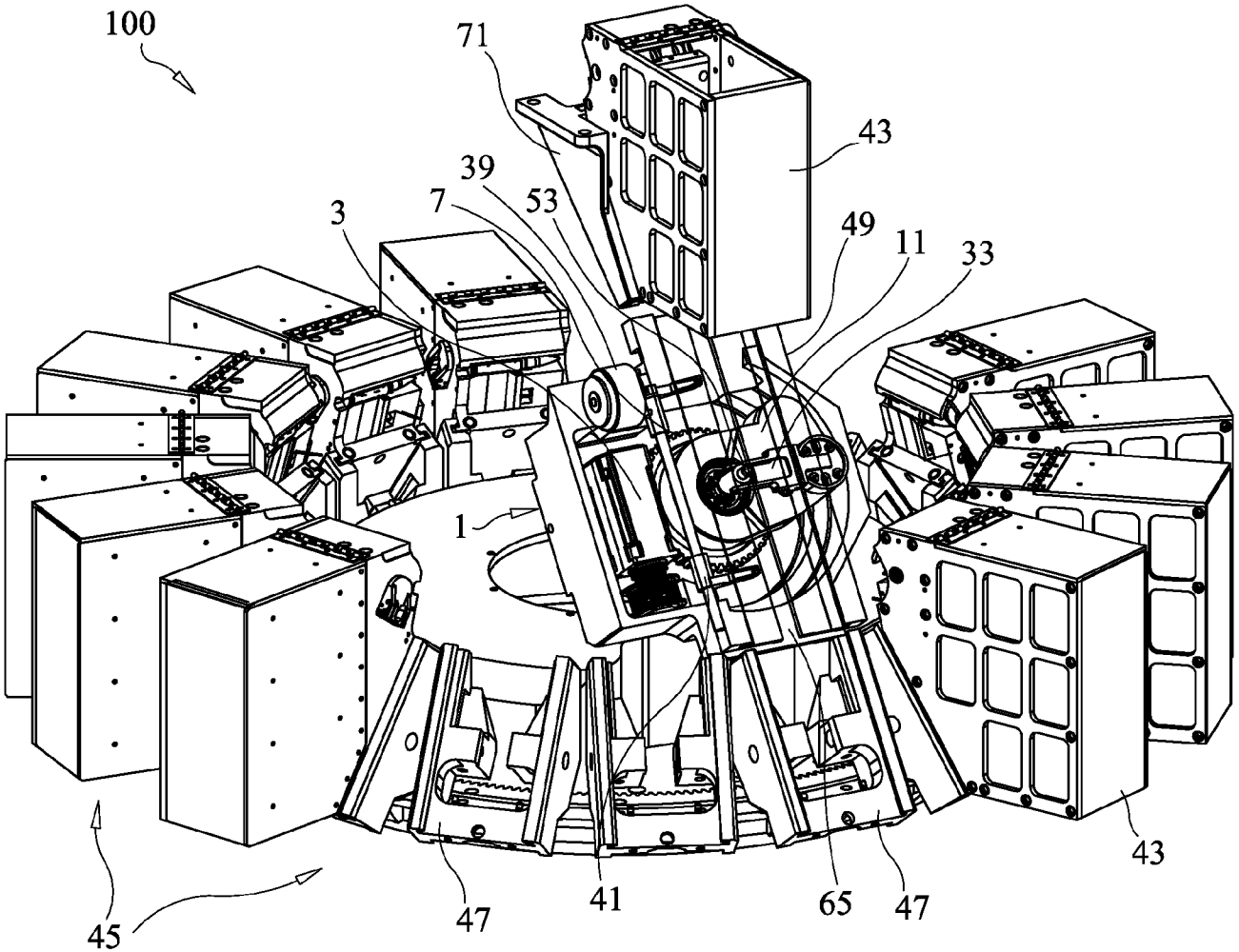
FIG. 1 is a partially transparent, perspective view of an embodiment of a payload storage and transport system, including a transporter, payloads, and a storage assembly which may have a curved shape.

FIG. 1 is a partially transparent, perspective view of an embodiment of a payload storage and transport system 100 that may include a transporter 1, a storage assembly 45, and one or more payloads 43. For clarity, the track 49 appears transparent in FIGS. 1 and 2. Payloads 43 may, in general, have any shape or size. The transporter 1 and storage assembly 45 may be positioned relative to one another to enable loading and unloading of payloads 43 from the storage assembly 45. One of the transporter 1 and the storage assembly 45 may be movable relative to the other, or both the transporter 1 and the storage assembly 45 may be movable. Storage assembly 45 may include retention slots 47 for storing payloads 43. A payload 43 may be removed from a retention slot 47 of the storage assembly 45, transported up (or down) the track 49 by the transporter 1 to a "use slot" 71, and returned to the retention slot 47. Transporter 1 may transport one or more payloads 43 in a linear path, for example, along parallel rails 51 of a track 49. Retention slot 47 and use slot 71 may also include parallel rails 51.

Figure 2:
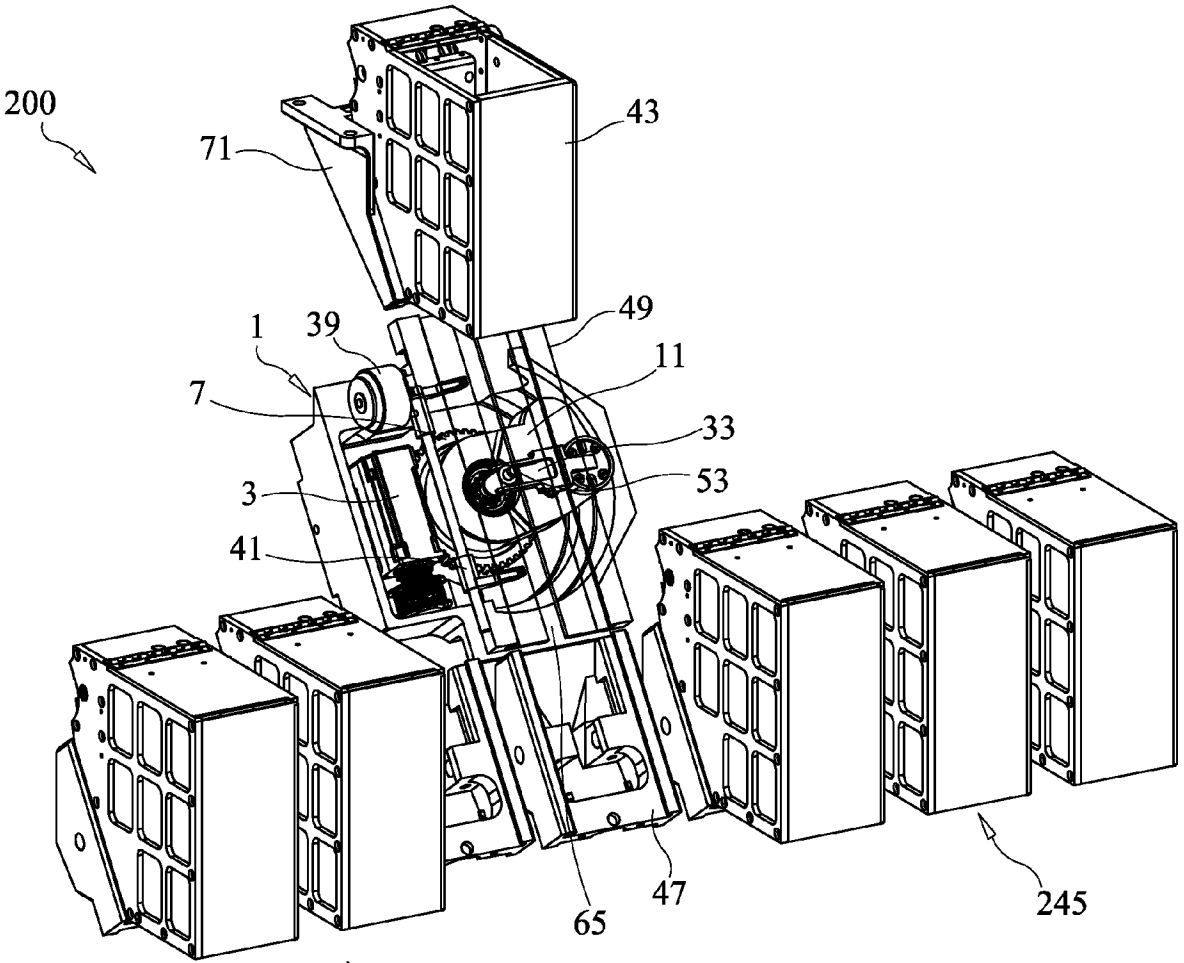
FIG. 2 is a partially transparent, perspective view of another embodiment of a payload storage and transport system, including a transporter, payloads, and a storage assembly which may have a linear shape.

In FIG. 1, the storage assembly 45 may have a curved shape. That is, the retention slots 47 may be arranged in a circular manner FIG. 2 is a perspective view of another embodiment of a payload storage and transport system 200, including a transporter 1, payloads 43, and a storage assembly 245 which may retention slots 47 arranged in a linear fashion. Mechanisms (not shown in the Figs.) for moving the retention slots 47 of storage assemblies 45, 245 are known. For example, for a curved storage assembly 45, retention slots 47 may be mounted on a large bearing that is attached to a large gear. The large gear may mesh with a small pinion gear. The small pinion gear may be driven by a servo motor.

Figure 3:
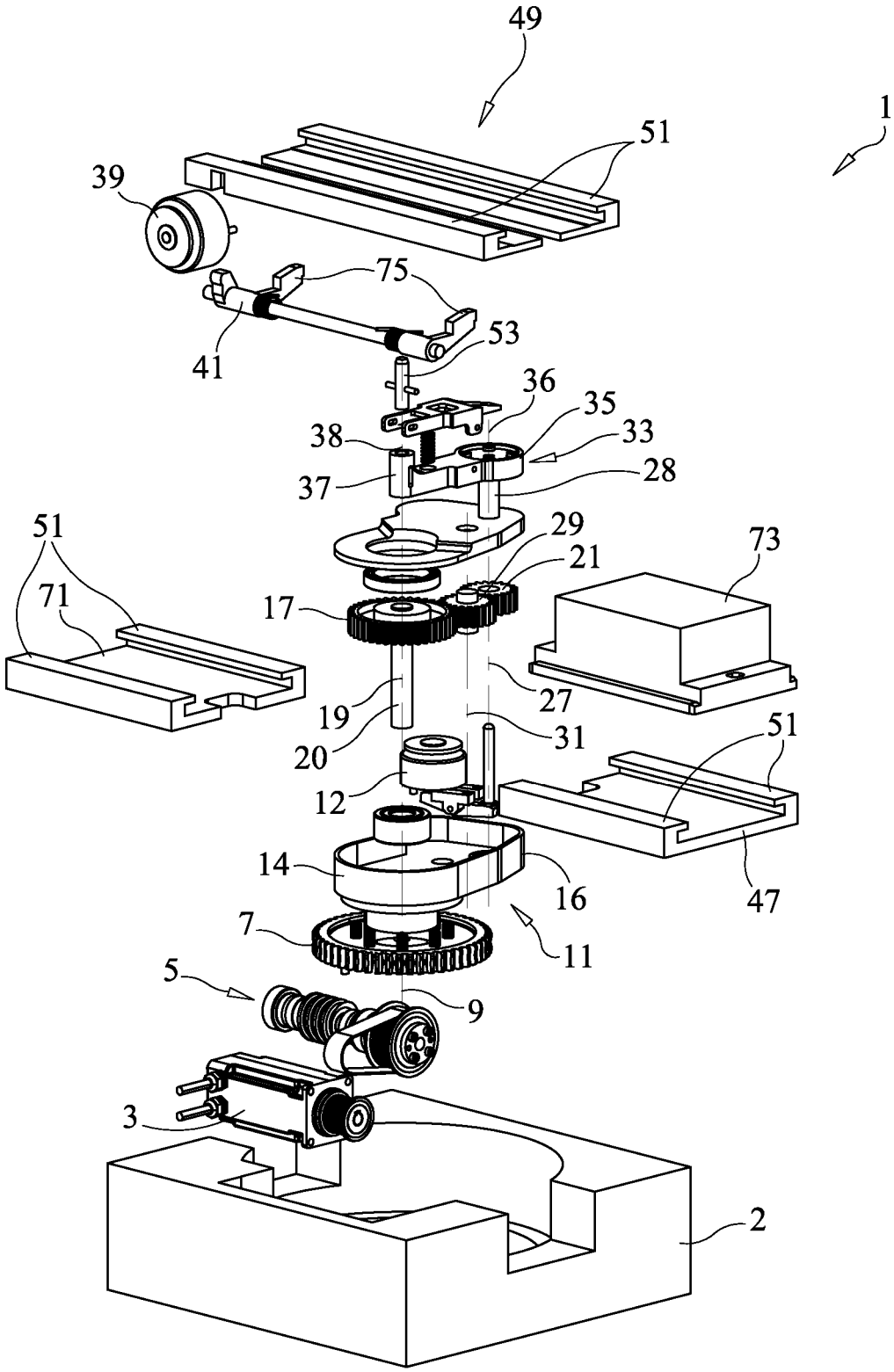
FIG. 3 is an exploded, partial, perspective view of an embodiment of a transporter.
Figure 4:
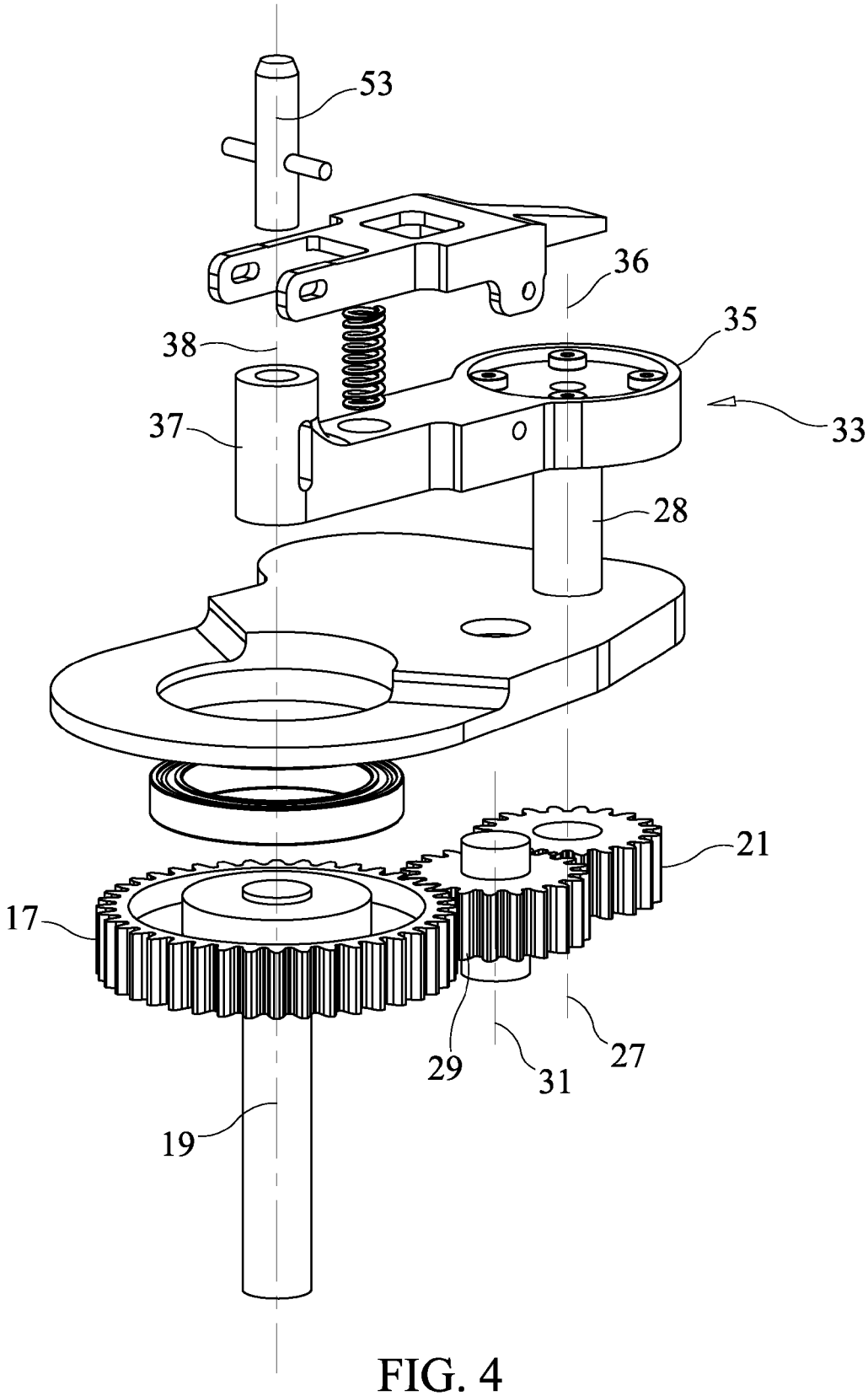
FIG. 4 is an enlarged view of a portion of FIG. 1.
Figure 5:
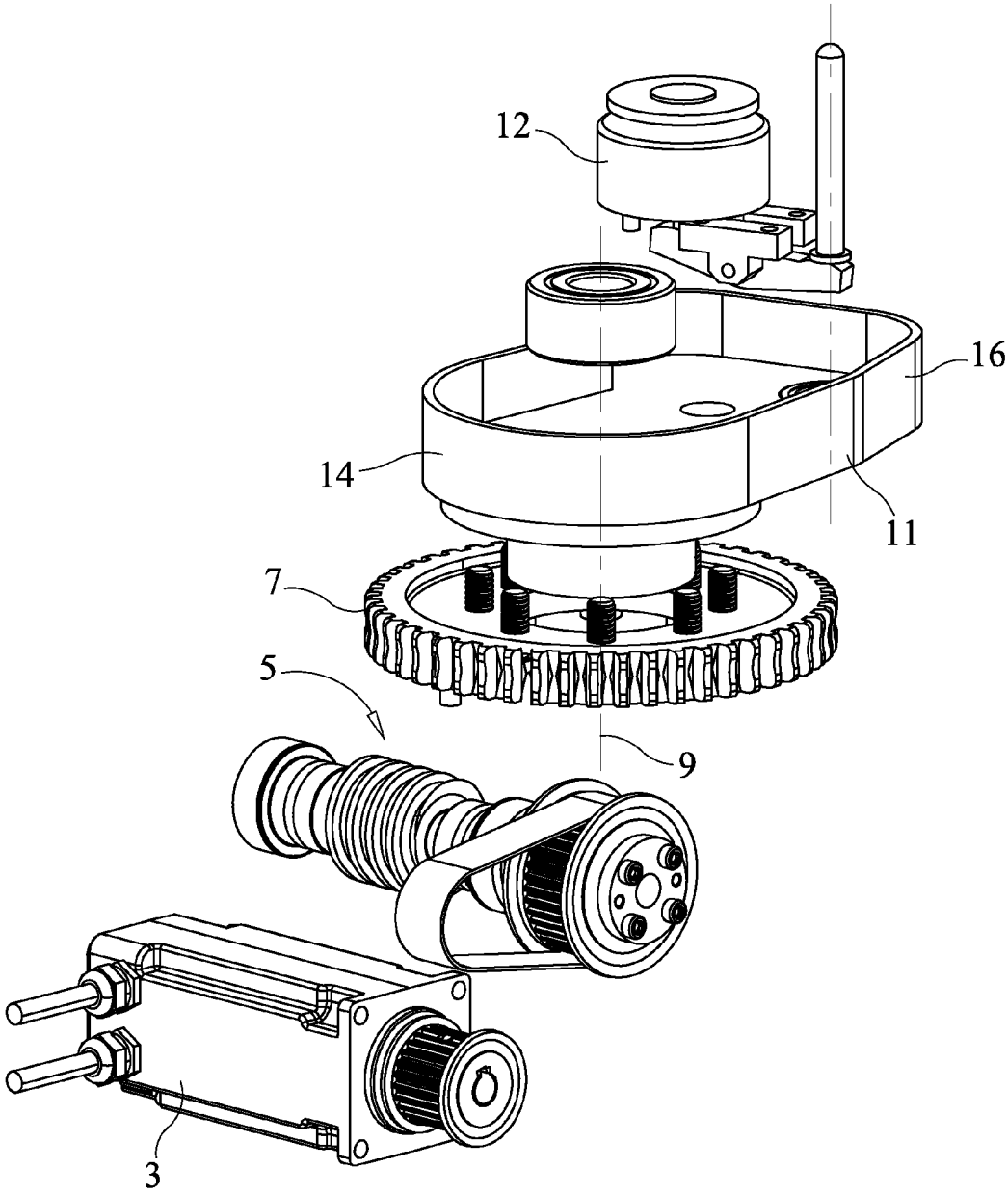
FIG. 5 is an enlarged view of another portion of FIG. 1.
Figure 14B:
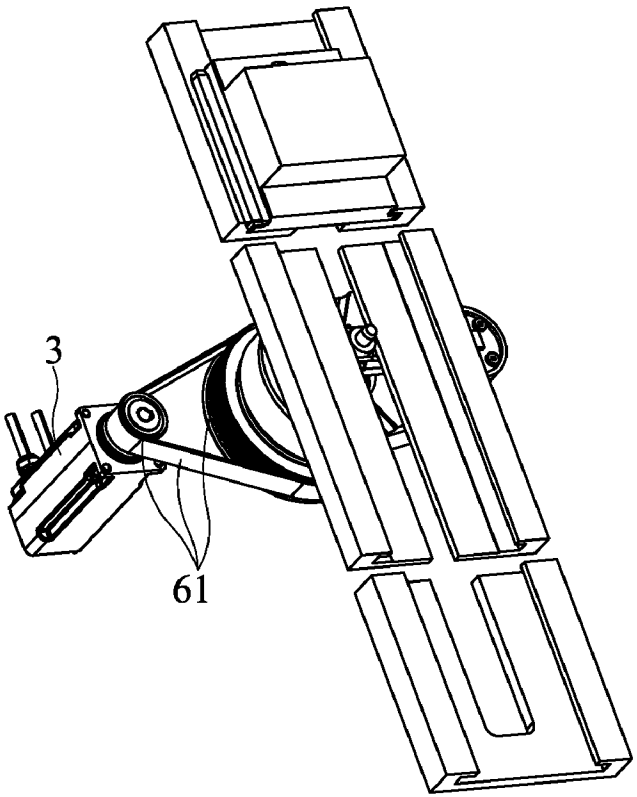
FIGS. 14(*a*)-(*b*) are partially transparent front and perspective views, respectively, of a transporter wherein the motor is connected to the first arm assembly via a belt and sprocket system.
Figure 14A:
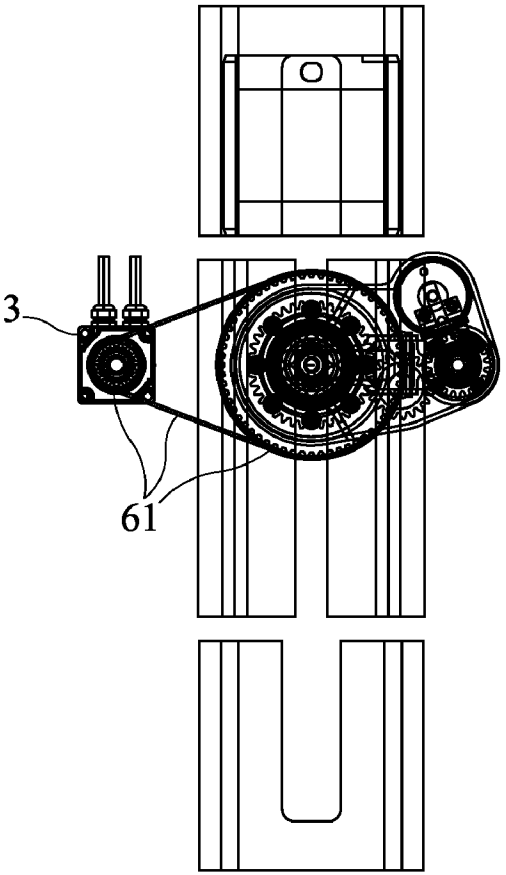
Figure 15B:
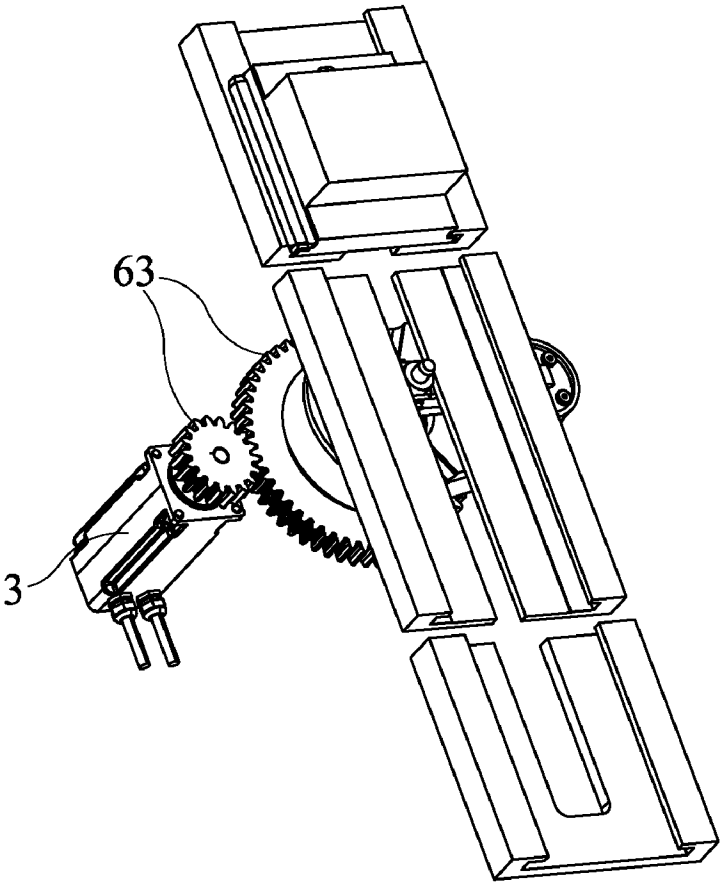
FIGS. 15(*a*)-(*b*) are partially transparent front and perspective views, respectively, of a transporter wherein the motor is connected to the first arm assembly via a spur gear set.
Figure 15A:
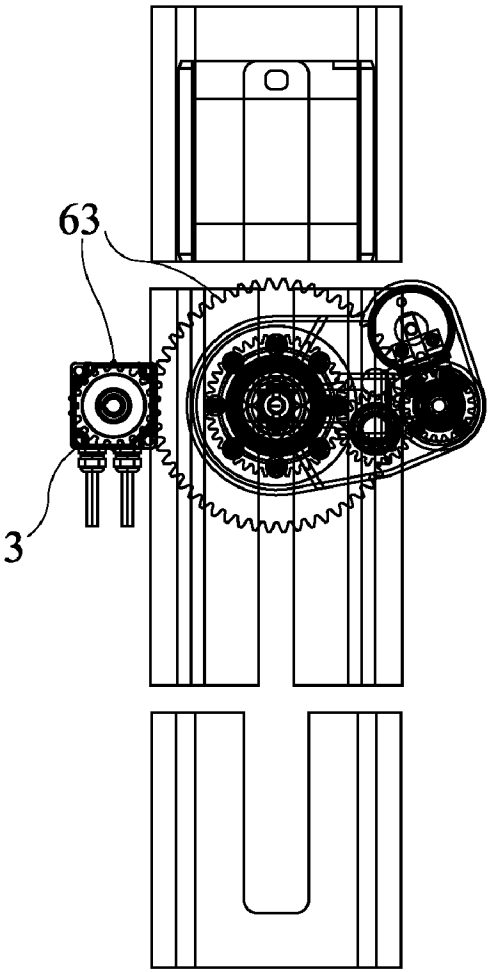

FIG. 3 is an exploded, partial, perspective view of an embodiment of a transporter 1. FIGS. 4 and 5 are enlarged views of portions of FIG. 3. Transporter 1 may include a motor 3. As used herein, "motor" means, for example, an electric, hydraulic or pneumatic motor, or any other type of rotative driver capable of driving (rotating) the worm gear 7. An operator may energize the motor 3 via any wired or wireless means. In one embodiment, the motor 3 may drive a worm 5, which drives the worm gear 7. In another embodiment, the motor 3 may drive the transporter 1 via a belt and sprockets 61, as shown in FIGS. 14(*a*)-(*b*). In a further embodiment, the motor 3 may drive the transporter 1 via a direct geared arrangement 63, as shown in FIGS. 15(*a*)-(*b*).

Referring again to FIGS. 3-5, worm gear 7 may have an axis 9. A first arm assembly 11 may include first and second ends 14, 16. First arm assembly 11 may be rigidly connected to worm gear 7 adjacent end 14 of first arm assembly 11. First arm assembly 11 may include a gear 17 having an axis 19. Gear 17 may be rigidly connected to a stationary base 2 via a shaft 20. Thus, gear 17 may be stationary, with respect to base 2, throughout the operation of the transporter 1.

A gear 21, having an axis 27, may be disposed in rotatable communication with gear 17 via idler gear 29. Idler gear 29, having an axis 31, may be disposed between and engage gears 17 and 21. A second arm assembly 33 may be rigidly connected to gear 21 via shaft 28. The second arm assembly 33 may include first and second ends 35, 37. Rotation of gear 21 may rotate the second arm assembly 33 about its axis 36. This rotation may move the end 37 of the second arm assembly 33 in a circular arc of travel.

Worm 5 may be operable to drive worm gear 7 about its axis 9, thereby rotating the first arm assembly 11. First arm assembly 11 may be rigidly attached to worm gear 7. In one embodiment, worm gear 7 may be formed integrally with the first arm assembly 11. Rotation of the first arm assembly 11 about the axis 19 of gear 17 may rotate idler gear 29, which meshes with and rotates around stationary gear 17. Rotation of the idler gear 29 may thereby rotate the gear 21 in a direction opposite to that of idler gear 29.

Maintaining the distance between the axis 19 of gear 17 and the axis 27 of gear 21 substantially equal to the distance between the axes 36 and 38 of the second arm assembly 33 may enable travel of the axis 38 of the second arm assembly 33 in a linear path. The gear ratio of gear 17 to gear 21 may be 2:1.

Figure 6A:
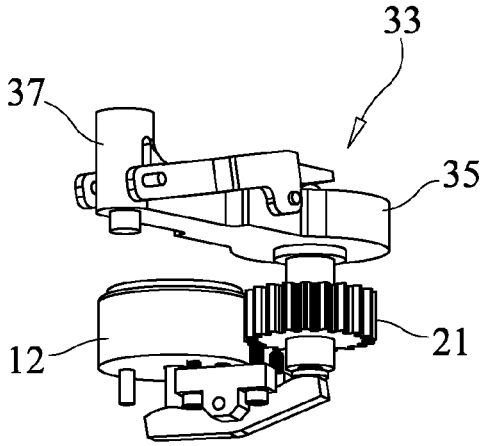
FIGS. 6(*a*)-(*b*) are perspective and partially sectioned perspective views, respectively, of the second arm assembly and a solenoid, wherein the solenoid is energized to retract the payload engager.
Figure 6B:
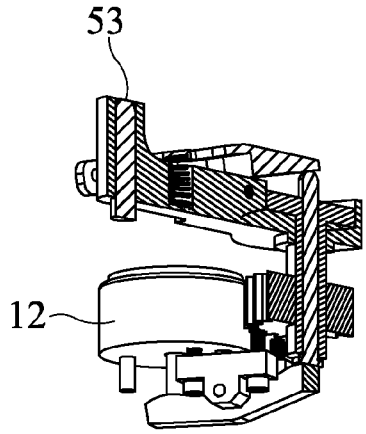
Figure 7A:
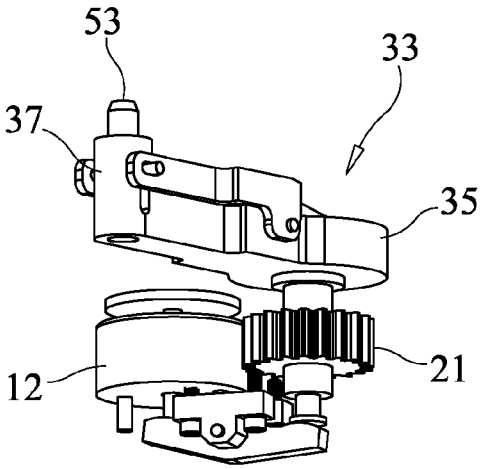
FIGS. 7(*a*)-(*b*) are perspective and partially sectioned perspective views, respectively, of the second arm assembly and a solenoid, wherein the solenoid is de-energized to engage the payload engager with a payload.
Figure 7B:
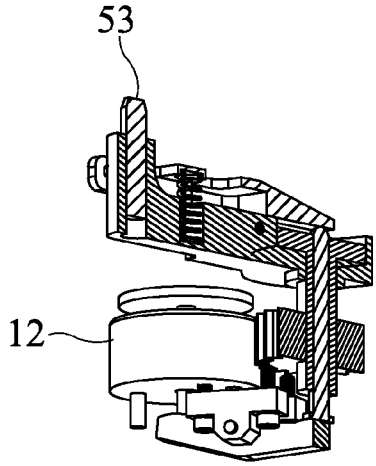

A payload engager 53 may be disposed concentric with the axis 38 of the second arm assembly 33. Payload engager 53 may be extended or retracted via a solenoid 12 to engage and disengage with a payload 43. FIGS. 6(*a*)-(*b*) are perspective and partially cutaway perspective views, respectively, of the second arm assembly 33 and solenoid 12. In FIGS. 6(*a*)-(*b*), the solenoid 12 is energized to retract the payload engager 53. FIGS. 7(*a*)-(*b*) are perspective and partially cutaway perspective views, respectively, of the second arm assembly 33 and solenoid 12. In FIGS. 7(*a*)-(*b*), the solenoid 12 is de-energized to extend the payload engager 53 into engagement with a payload. In one embodiment, the payload engager 53 may be, for example, a pin, as shown in FIGS. 6-7. Payload engager 53 may have a form other than a pin, for example, any form suitable for engaging with a particular payload may be used.

Figure 19B:
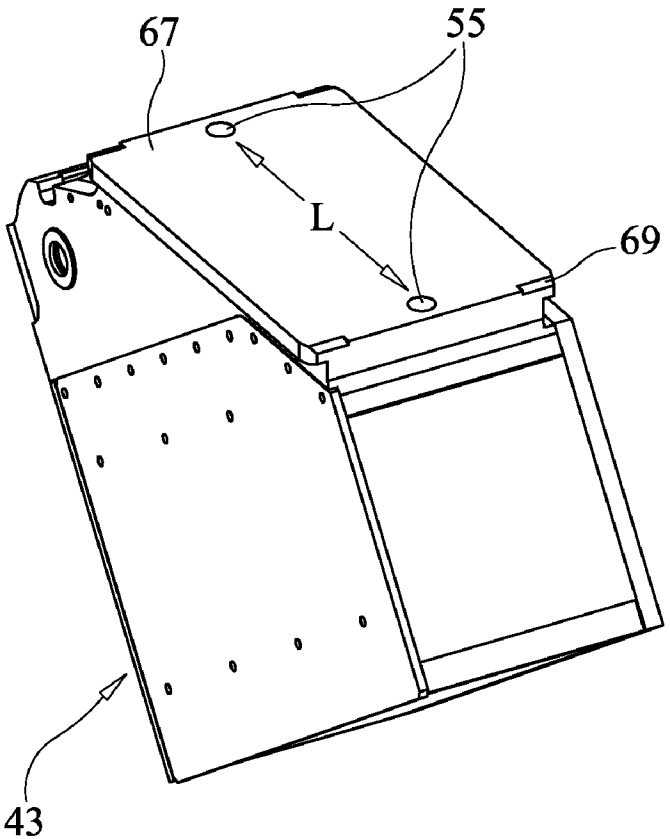
FIGS. 19(*a*)-(*b*) are top and bottom perspective views, respectively, of one embodiment of a payload.
Figure 19A:
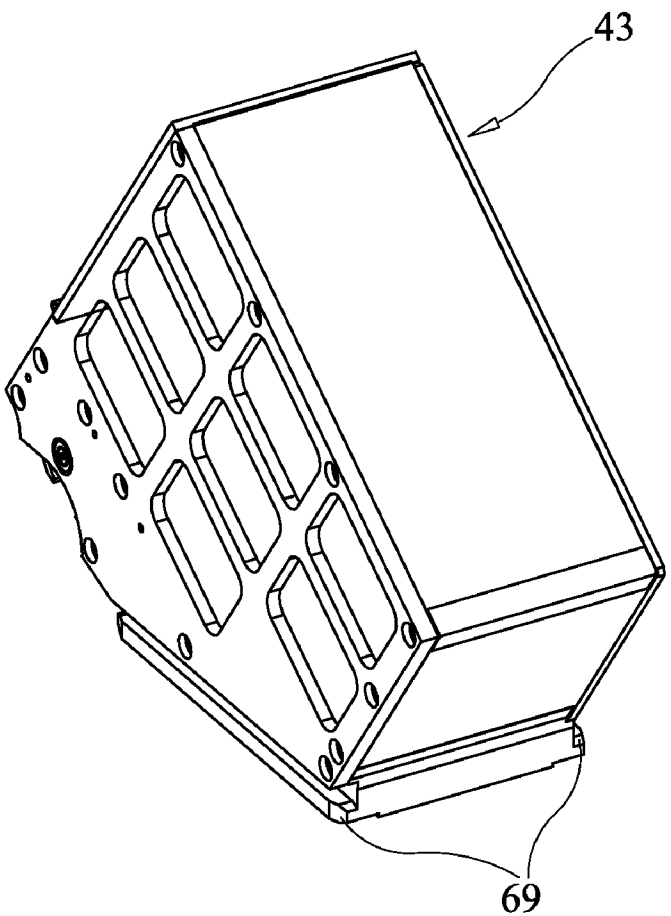

FIGS. 19(*a*)-(*b*) are top and bottom perspective views, respectively, of one embodiment of a payload 43. Payload 43 may include openings 55 formed on an underside 67. Payload engager 53 may engage and disengage openings 55 in payload 43 to move payload 43 along track 49. Payload 43 may include extended edges 69 that slide in rails 51. Payload engager 53 may move in a longitudinal opening 65 (FIG. 1) in track 49.

Figure 8B:
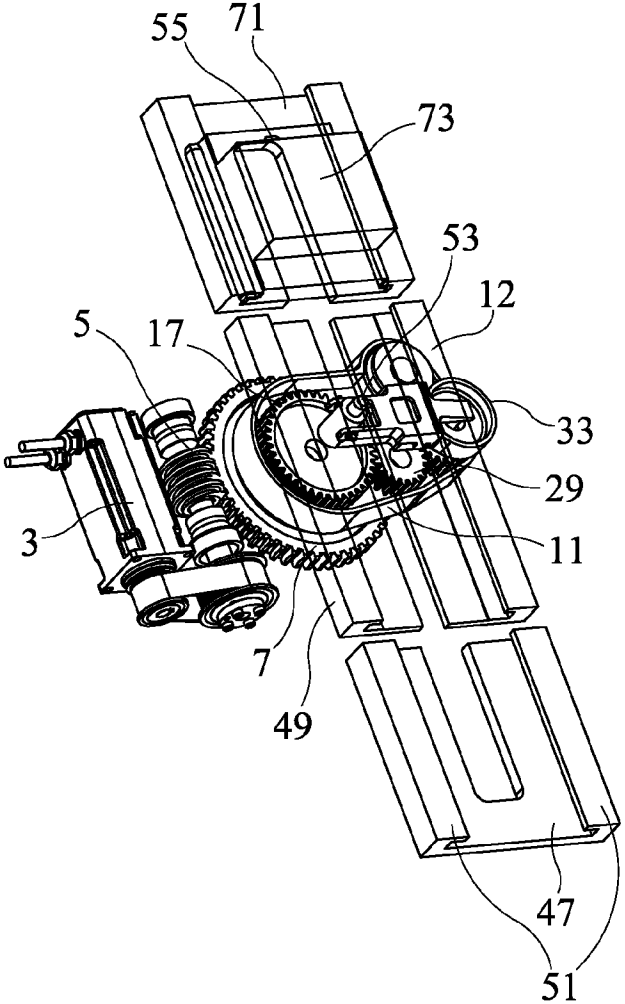
FIGS. 8(*a*)-(*b*) are partially transparent front and perspective views, respectively, of one embodiment of a transporter in a start position.
Figure 8A:
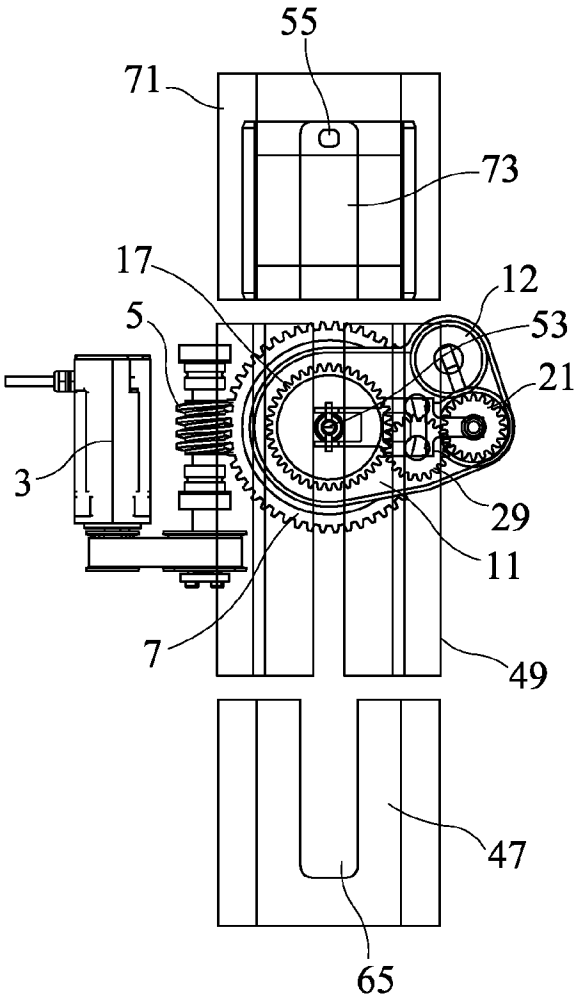

FIGS. 8-11 show positions of transporter 1 when transporting a payload 73 from, for example, a use slot 71 to a retention slot 47. Use slot 71 and retention slot 47 may include longitudinal openings 65 in which the payload engager 53 may move. A start position may be as shown in FIGS. 8(*a*)-(*b*). In the start position, the first and second arm assemblies 11 and 33 may be positioned substantially perpendicular to the direction of travel along the track 49. Payload 73 may be maintained in position in the use slot 71 by a variety of means, for example, a crosspin and solenoid (not shown), ball spring plungers and detents (not shown), etc.

Figure 9B:
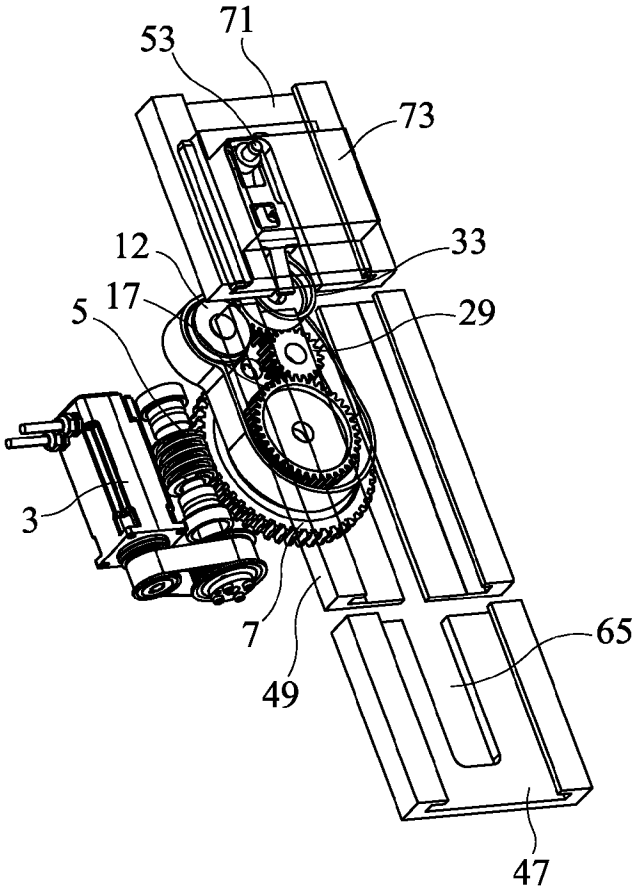
FIGS. 9(*a*)-(*b*) are partially transparent front and perspective views, respectively, of a transporter in a second position, wherein the transporter has been actuated to move the payload engager into engagement with the payload.
Figure 9A:
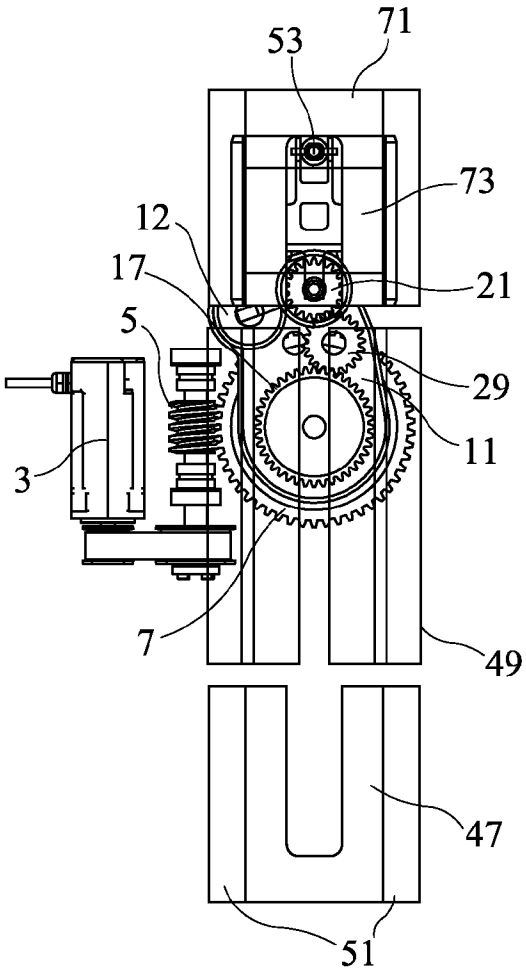

Moving from the start position to a second position shown in FIGS. 9(*a*) and 9(*b*), rotation of worm gear 7 may rotate first arm assembly 11 upwards, thereby rotating gear 21 and second arm assembly 33. Rotation of second arm assembly 33 may cause payload engager 53 to be positioned beneath an opening 55 in payload 73, as in FIGS. 9(*a*)-(*b*). When engager 53 is beneath opening 55, solenoid 12 may be de-energized (see FIGS. 5(*a*)-(*b*)) to thereby engage the payload 73. The second arm assembly 33 may then be parallel to rails 51 and below the user slot 71.

Figure 10B:
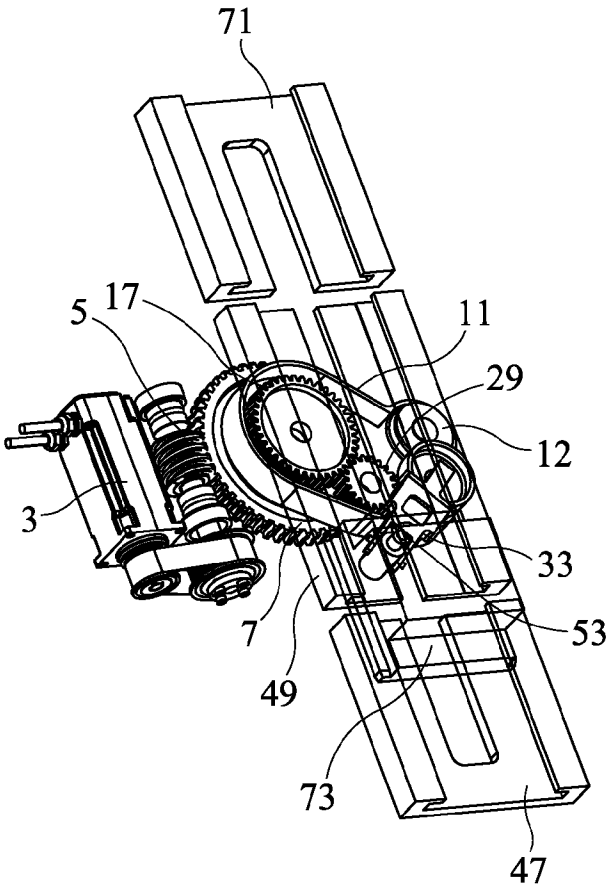
FIGS. 10(*a*)-(*b*) are partially transparent front and perspective views, respectively, of a transporter in a third position, wherein the transporter has moved the payload engager partially down the rails.
Figure 10A:
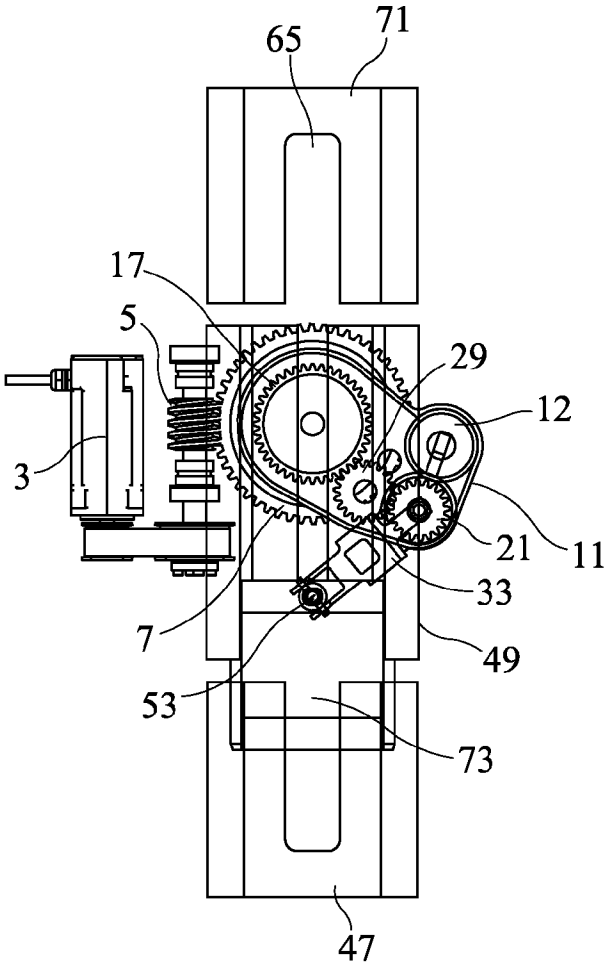
Figure 11B:
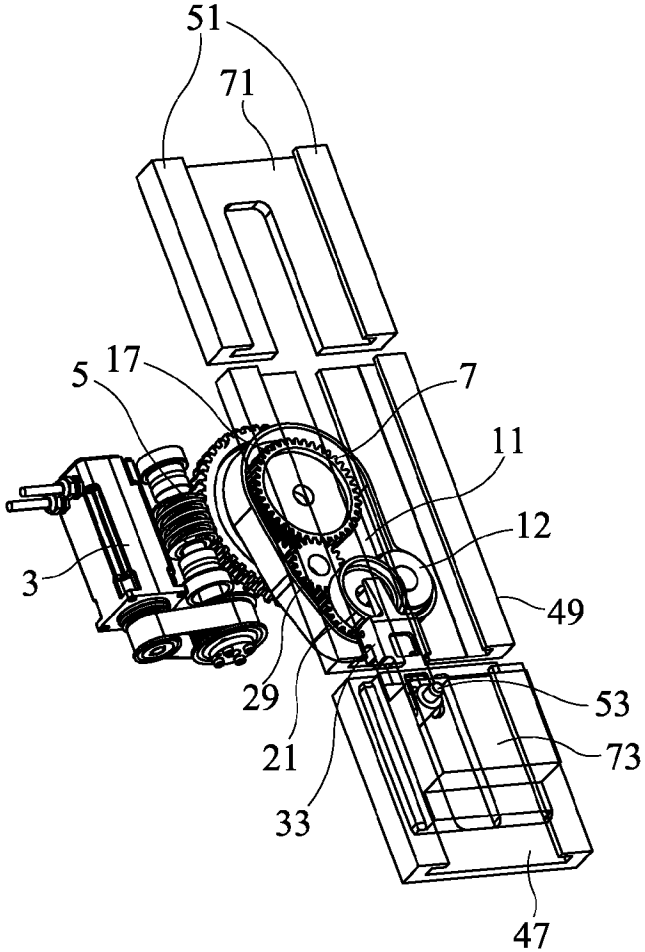
FIGS. 11(*a*)-(*b*) are partially transparent front and perspective views, respectively, of a transporter in an end position, wherein the transporter has moved the payload engager down the rails and into the storage assembly.
Figure 11A:
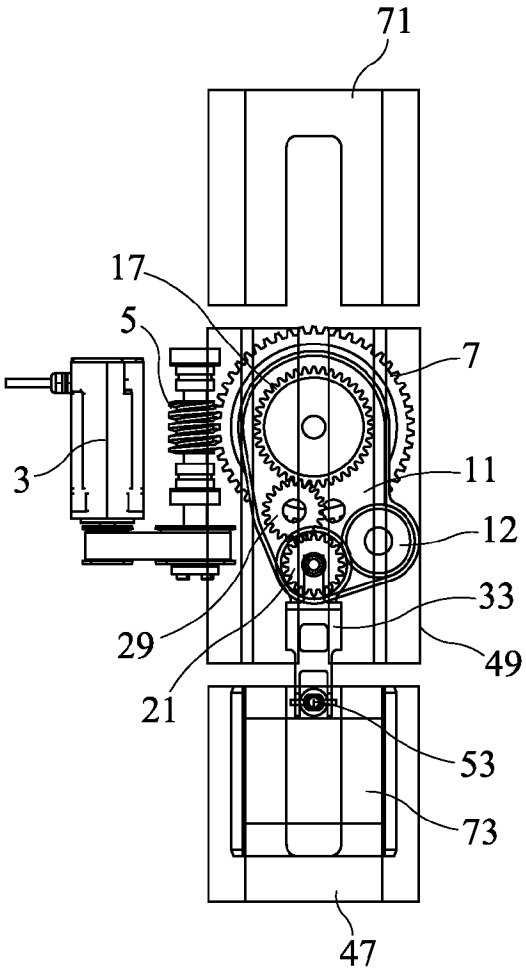

Worm gear 7 may then be rotated in an opposite direction by worm 5, thereby swinging second arm assembly 33 downwards, and causing the payload engager 53 to slide the payload 73 partially down the track 49, as in FIGS. 10(*a*)-(*b*). Worm gear 7 may continue to rotate, causing the second arm assembly 33 to reach a position parallel to rails 51 and adjacent the retention slot 47 at the end of track 49, as in FIGS. 11(*a*)-(*b*).

In FIGS. 8-11, the payload 73 may be moved a distance along the tracks 49 equal to the full range of travel of the payload engager 53. Depending upon the application, it may be desired to move a payload a distance greater than the full range of travel of the payload engager 53. This may be achieved by using a stop mechanism 41 (FIGS. 1-3) to retain the payload along track 49 at a location between the ends of the track 49. Stop mechanism 41 may include one or more supports 75. The payload may bear against a support 75 to thereby retain the payload in a position between the ends of track 49. The stop mechanism may be activated by a second solenoid 39.

When the second solenoid 39 is actuated, the stop mechanism 41 may rotate upwardly so that the supports 75 are adjacent the payload. After the stop mechanism 41 retains the payload, the payload engager 53 may disengage from a first point on the payload. Transporter 1 may then be rotated to move the payload engager 53 to a different location. Then, the payload engager 53 may re-engage with the payload at a second point on the payload. The stop mechanism 41 may then be rotated downward, and the transporter 1 may continue moving the payload along the track 49 until reaching a final position.

As seen in FIGS. 1 and 2, stop mechanism 41 may be disposed adjacent track 49. The solenoid 39 may be disposed in communication with the stop mechanism 41. Solenoid 39 may removably engage the stop mechanism 41 with the payload 43 during travel of the payload 43 along the track 49. Payload 43 may include one or more payload slots 55 (FIG. 19(*b*)) for removable engagement with the payload engager 53. Compared to the distance of travel without a stop mechanism 41, the total distance of travel of the payload 43 may be increased by the distance L (FIG. 19(*b*)) between the payload slots 55.

Figure 12B:
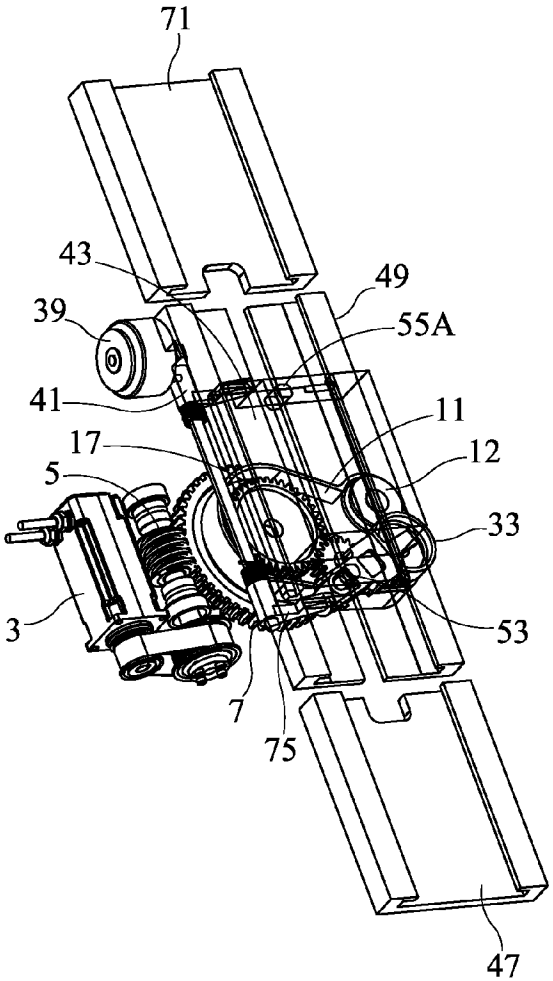
FIGS. 12(*a*)-(*b*) are partially transparent front and perspective views, respectively, of a transporter with a stop mechanism.
Figure 12A:
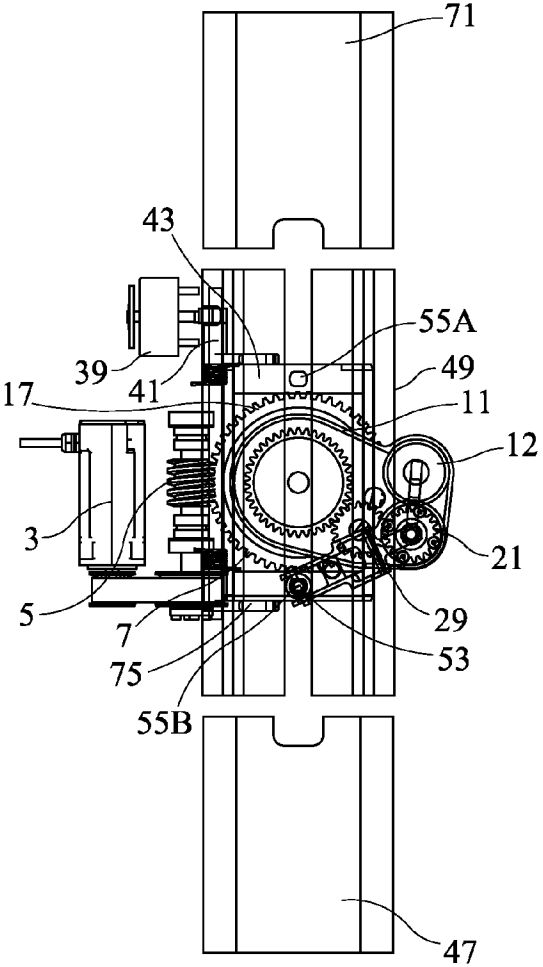

FIGS. 12(*a*)-(*b*) are front and perspective views, respectively, of the transporter 1 that includes a stop mechanism 41 and a solenoid 39 for actuating the stop mechanism 41. In the embodiment of FIGS. 12(*a*)-(*b*), the retention slot 47 and the use slot 71 need not, but may include longitudinal openings 65. The payload engager 53 is in engagement with a lower opening 55B in payload 43. The transporter 1 has moved the payload 43 from a position in the use slot 71 to a position along the track 49, as shown in FIGS. 12(*a*)-(*b*). At this position, the solenoid 39 activates the stop mechanism 41, which rotates upward so that the payload 43 may rest against support 75. Solenoid 12 may now be energized to retract engager 53 from lower opening 55B in payload 43. Transporter 1 may then be rotated to the position shown in FIGS. 13(*a*)-(*b*).

Figure 13B:
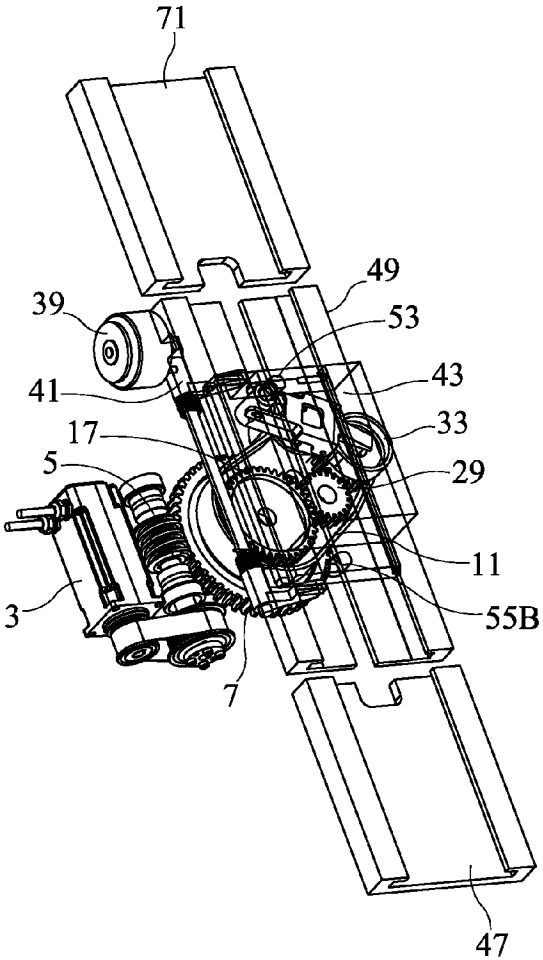
FIGS. 13(*a*)-(*b*) are partially transparent front and perspective views, respectively, of the transporter of FIGS. 12(*a*)-(*b*), wherein the payload engager has disengaged from a first opening on the payload and engaged with a second opening on the payload.
Figure 13A:
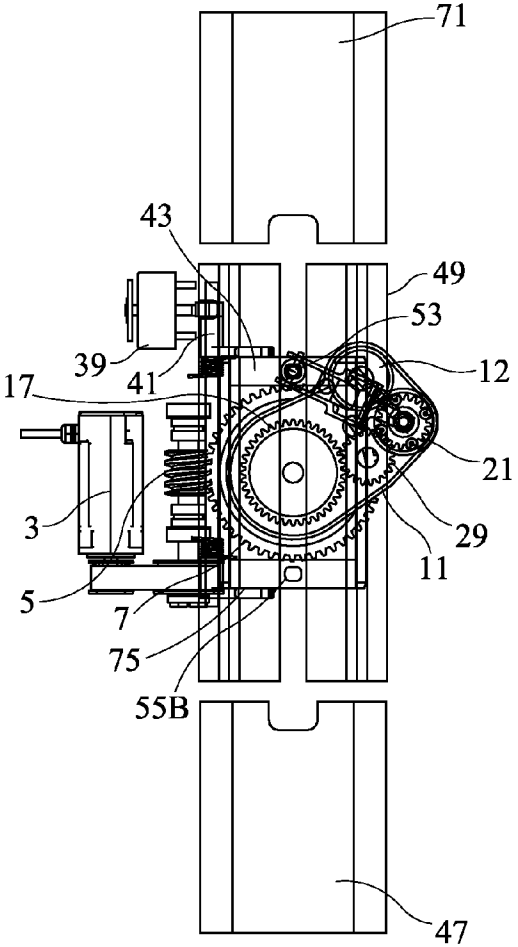

FIGS. 13(*a*)-(*b*) are front and perspective views, respectively, of the transporter of FIGS. 12(*a*)-(*b*). In FIGS. 13(*a*)-(*b*), the payload engager 53 has now engaged with upper opening 55A in payload 43. Stop mechanism 41 may now be rotated downward via solenoid 39 so that supports 75 no longer block the path of travel of payload 43. Then, transporter 1 may be further rotated to move payload 43 to the retention slot 47.

Figure 16B:
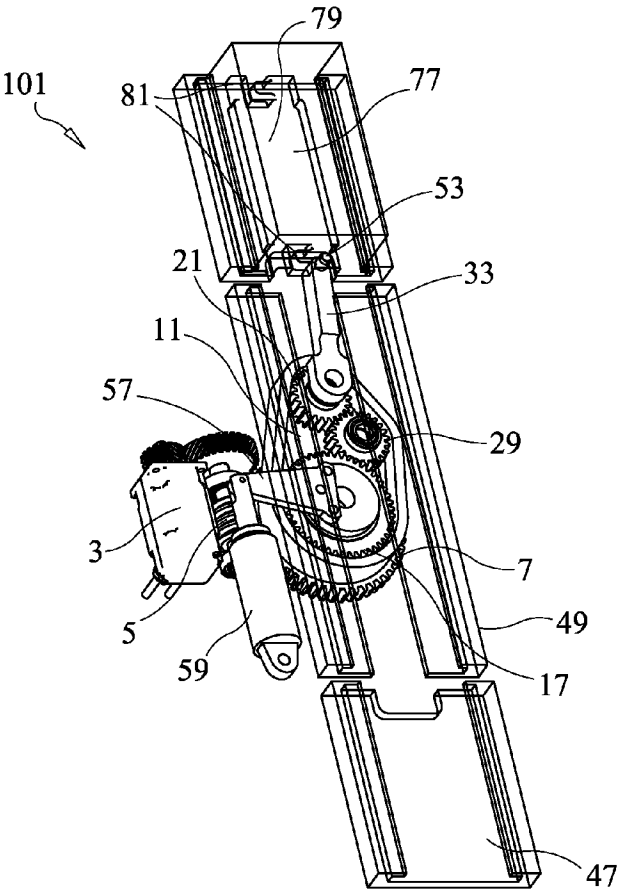
FIGS. 16(*a*)-(*b*) are partially transparent front and perspective views of another embodiment of a transporter wherein the payload engager is about to engage with a payload.
Figure 16A:
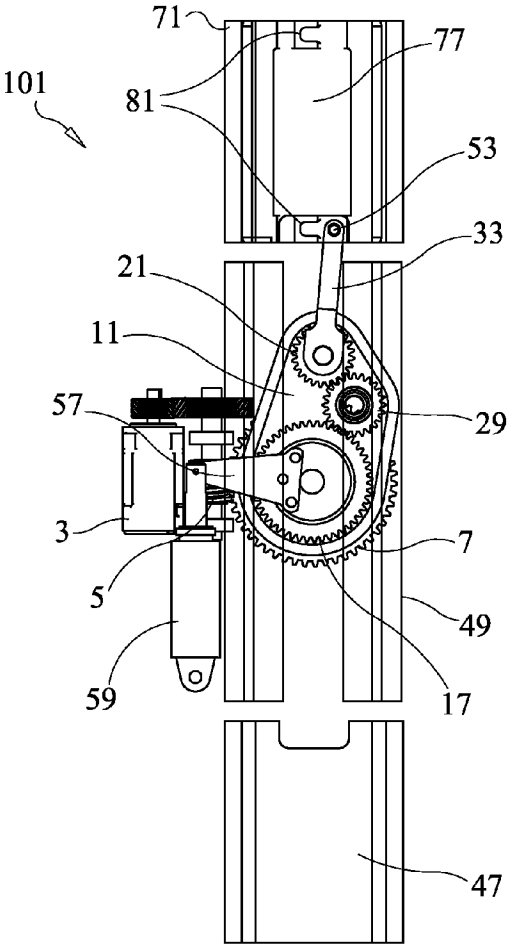
Figure 17B:
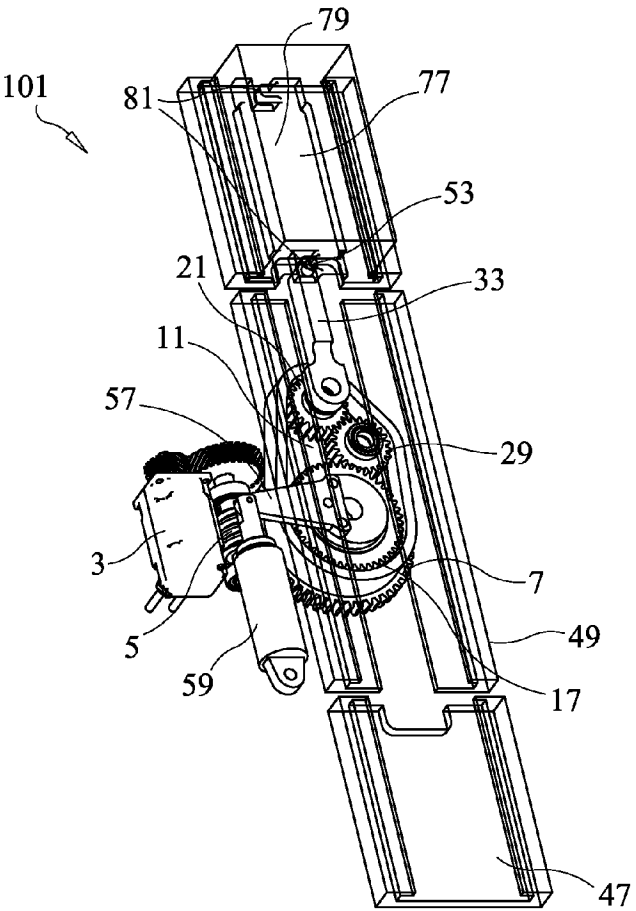
FIGS. 17(*a*)-(*b*) are partially transparent front and perspective views, respectively, of the transporter of FIGS. 16(*a*)-(*b*), wherein the payload engager has engaged with the payload.
Figure 17A:
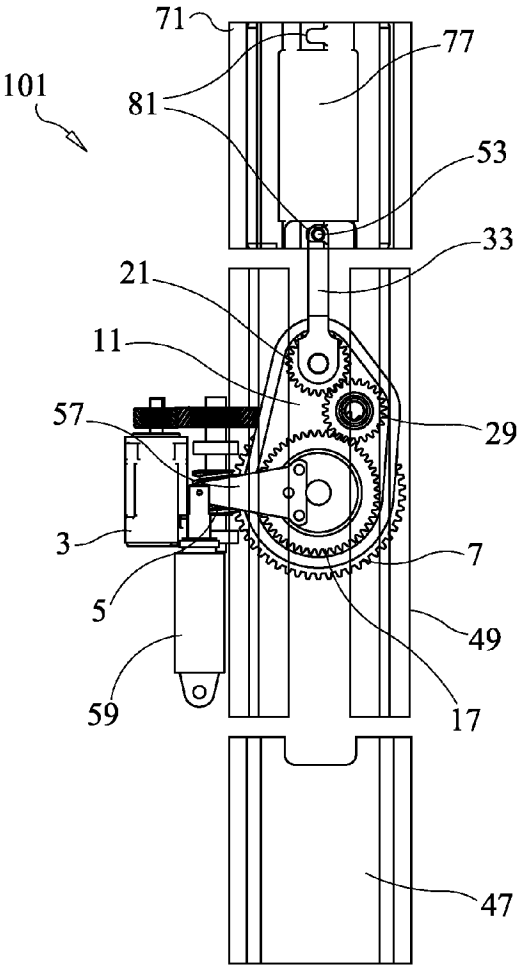
Figure 18B:
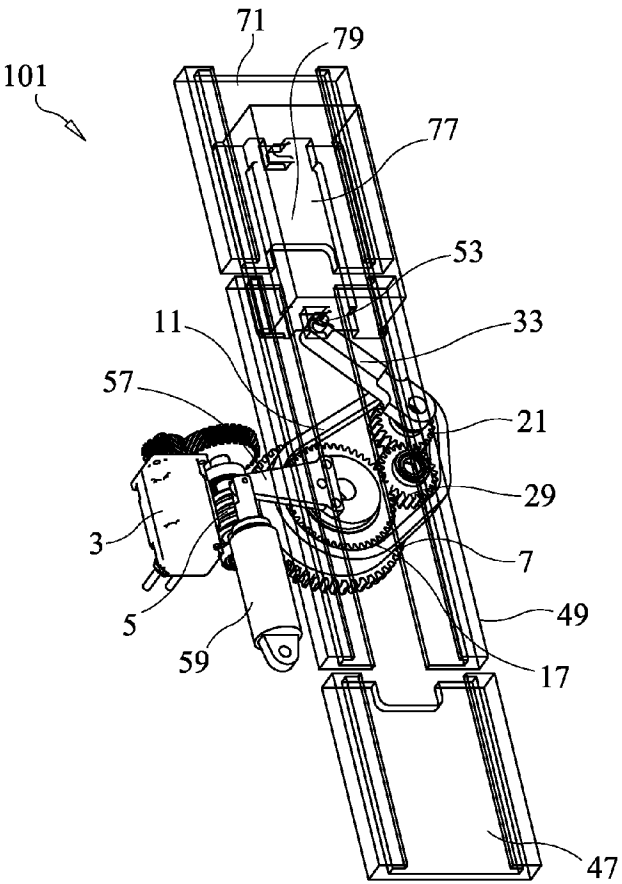
FIGS. 18(*a*) and 18(*b*) are partially transparent front and perspective views, respectively, of the transporter of FIGS. 16(*a*)-(*b*), wherein the payload engager has travelled linearly down the track, resulting in transport of the payload partially down the track.
Figure 18A:
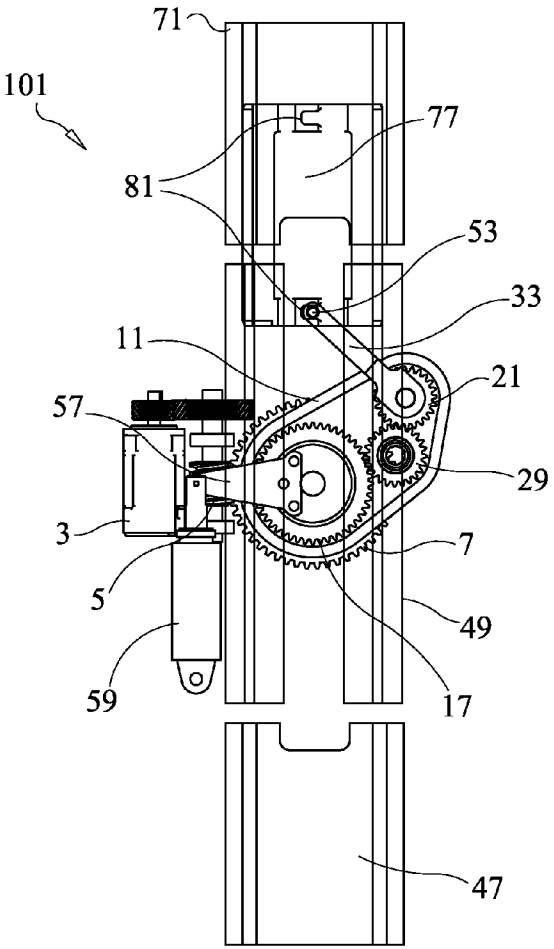

In transporter 1, gear 17 may be rigidly fixed and stationary with respect to stationary base 2 (FIG. 3). That is, gear 17 may not move or rotate with respect to base 2. In another embodiment, gear 17 may rotate with respect to base 2. That is, gear 17 may be rigidly fixed to shaft 20 and shaft 20 may rotate with respect to base 2. FIGS. 16-18 show an embodiment of a transporter 101 in which gear 17 may rotate with respect to base 2.

Transporter 101 may include an actuator 59 that may rotate gear 17 via a drive arm 57. Actuator 59 is shown in FIGS. 16-18 as a linear actuator, but, a rotational actuator, such as motor, could also be used. Actuator 59 may control movement of second arm assembly 33 independent of the movement of first arm assembly 11. In this manner, the payload engager 53 may move not only parallel to rails 51, but also lateral to rails 51.

FIGS. 16(*a*)-(*b*) show a payload 77 having a recessed bottom surface 79 with slots 81 formed therein. Because payload engager 53 of transporter 101 may move laterally, payload engager 53 may slide into and out of slots 81 to engage and disengage payload 77. Thus, in transporter 101, solenoid 12 is not needed because there is no need to move payload engager 53 "up and down", that is, in the direction normal to the plane of FIG. 16(*a*).

As shown in FIGS. 16(*a*)-(*b*), drive arm 57 may be attached at one end to gear 17 and at the other end to actuator 59. Using the actuator 59, gear 17 may rotate about its axis 19. Actuator 59 may rotate gear 17 via the drive arm 57 to slide the payload engager 53 into a slot 81 on the bottom of the payload 77, as seen in FIGS. 17(*a*)-(*b*). Actuator 59 and gear 17 may remain in the position shown in FIGS. 17(*a*)-(*b*), and the motor 3 may then rotate the worm gear 7. Rotation of the worm gear 7 may rotate the first arm assembly 11, thereby rotating the idler gear 29 and the gear 21. Gear 21 may then rotate the second arm assembly 33, such that the payload engager 53 may move the payload 77 down the track 49, as shown in FIGS. 18(*a*)-(*b*).

Transporters 1, 101 are linear transport systems that are compact and may move a payload over a relatively large distance. The amount of space required by the transporters 1, 101 at the ends of its range of movement (use slot 71 and retention slot 47) is minimal. There is no permanent intrusion of the transporters 1, 101 into the areas of the use slot 71 and the retention slot 47. In a "home" position, where the first and second arm assemblies 11, 33 are perpendicular to the linear path of movement of a payload, the mechanisms of the transporters 1, 101 may be totally contained within a volume between the use slot 71 and the retention slot 47. Thus, the volume available for the use slot 71, retention slot 47, and their associated mechanisms is greater than in other linear transport systems.

The stop mechanism 41 increases the transport distance even more. The stop mechanism 41 further reduces the presence of the transporter mechanism into the areas at either end of its movement. The openings 55 (FIG. 19(*b*) in payload 43 may be located at the ends of the payload 43, rather than the midsection of the payload 43. Thus, the second arm assembly 33 does not have to extend very far under the payload 43 to engage an opening 55 in the payload 43. This is the case whether the payload 43 is in the use slot 71 or the retention slot 47.

The lateral motion of the payload engager 53 of transporter 101 simplifies the construction of the first and second arm assemblies 11, 33. That is, the solenoid 12 and its associated linkages, that may be part of transporter 1, may not be required in transporter 101.

The storage and transport system described with reference to FIGS. 1-19 may be a component of a remotely-operable, automatically-reloadable weapon system. A remotely-operable, automatically-reloadable weapon system will be described with reference to FIGS. 20-30.

Figure 20:
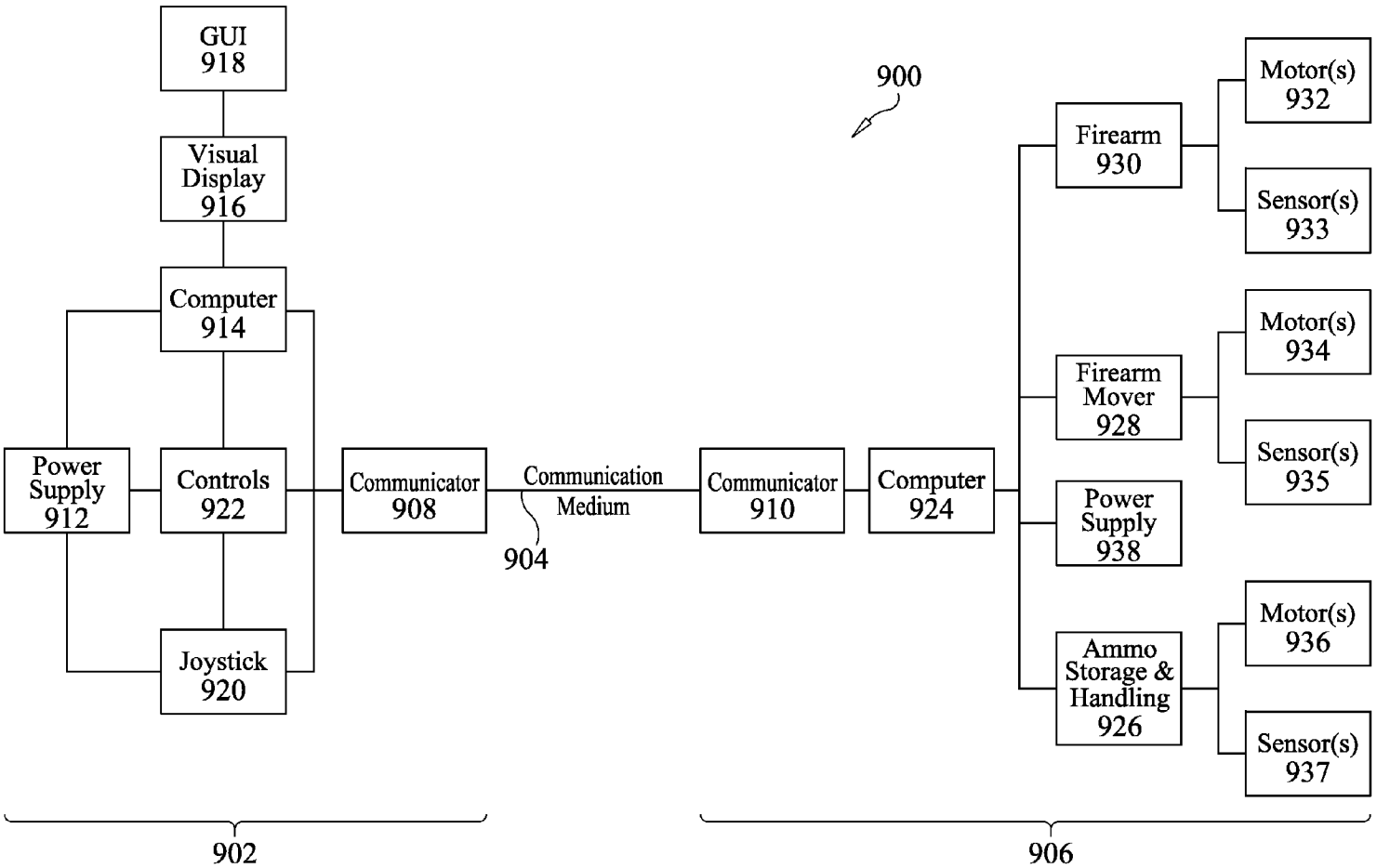
FIG. 20 is a schematic diagram of an embodiment of an automatically-reloadable, remotely-operated weapon system.

Referring to FIG. 20, a remotely-operable, automatically-reloadable weapon system 900 may include an operator station 902, a weapon station 906, and a communication medium or link 904. Communication medium 904 may be a wired medium, a wireless medium, or any other means for communicating information between the operator station 902 and the weapon station 906.

Operator station 902 and weapon station 906 may include respective communicators 908, 910 for exchanging information between them. Communicators 908, 910 may be any suitable communication device, such as, for example, a modem, a transmitter and a receiver, a transceiver, or other communication devices. Communicators 908, 910 and communication medium 904 may handle analog, digital, or both analog and digital signals. Communications between the communicators 908 and 910 may be encrypted. Operator station 902 and weapon station 906 may each include respective power supplies 912, 938.

The operator station 902 may be located distant from the weapon station 906. A human user may control the weapon station 906 from the operator station 902. Operator station 902 may include one or more computers 914 that may have visual displays 916. Displays 916 may include graphical user interfaces (GUIs) 918. Operator station 902 may include one or more joysticks 920 and additional controls 922. Additional controls 922 may include, for example, switches, dials, push buttons, knobs, etc.

The weapon station 906 may include a firearm 930. The firearm 930 may be externally-powered, for example, by a motor. A firearm is "externally-powered" if the power for cycling the firearm is independent of the operation of the weapon. For example, the cycling of an externally-powered firearm does not depend on products of combustion or recoil that are produced by the firearm. A reciprocally-cycled, externally-powered firearm suitable for firearm 930 is disclosed in pending U.S. patent application Ser. No. 12/607,393. An advantage of the firearm disclosed in application Ser. No. 12/607,393 is that it may be powered or driven by a variable speed motor, which, in conjunction with that firearm's novel operating and firing group, allows the firing rate of the firearm to be infinitely variable from zero to the design maximum of the firearm.

Weapon station 906 may include one or more computers 924, a firearm mover 928, and an ammunition storage and transport system 926. The firearm mover 928 may adjust the pointing direction of the firearm 930 in a known manner, for example, mover 928 may include a turret for changing the azimuth of the firearm 930 and an elevator for changing the angle of inclination of the firearm 930. The ammunition storage and transport system 926 may be an automatic system that does not require a human to physically move the ammunition to and from the firearm 930.

The firearm 930, the firearm mover 928, and the ammunition storage and transport system 926 may each include motors or actuators 932, 934, 936 and various sensors 933, 935, 937, respectively. The motors or actuators 932, 934, 936 may actuate components of the station 906. The sensors 933, 935, 937 may sense positions, states, or modes of the station 906, the station's components, and the surrounding environment. Sensors 933, 935, 937 may include, for example, video cameras, thermal cameras, infrared cameras, ultraviolet cameras, audio microphones, low frequency microphones, radio frequency receivers, position sensors, etc.

FIG. 20 is an example of a functional relationship of components that may be included in a remotely-operable, automatically reloadable weapon system 900. The components shown in FIG. 20, and the relationship of the components, are exemplary only. So long as the functions of the weapon system 900 are performed satisfactorily, the particular components used and the functions performed by each component may be varied.

System 900 may use standard, well-defined electrical and software interfaces that may be available on a wide variety of computers, microprocessors, and microcontrollers. As such, the embodiments of the system 900 may vary significantly and may be designed in accordance with the end-user requirements, rather than constrained by specific technologies or vendors. Furthermore, advances in technology that may provide increased capability may be easily incorporated in system 900 by replacing the system component with the newer technology. So, upgrades to system 900 may be less costly and may ensure that the system 900 remains at the forefront of technology.

Figure 21:
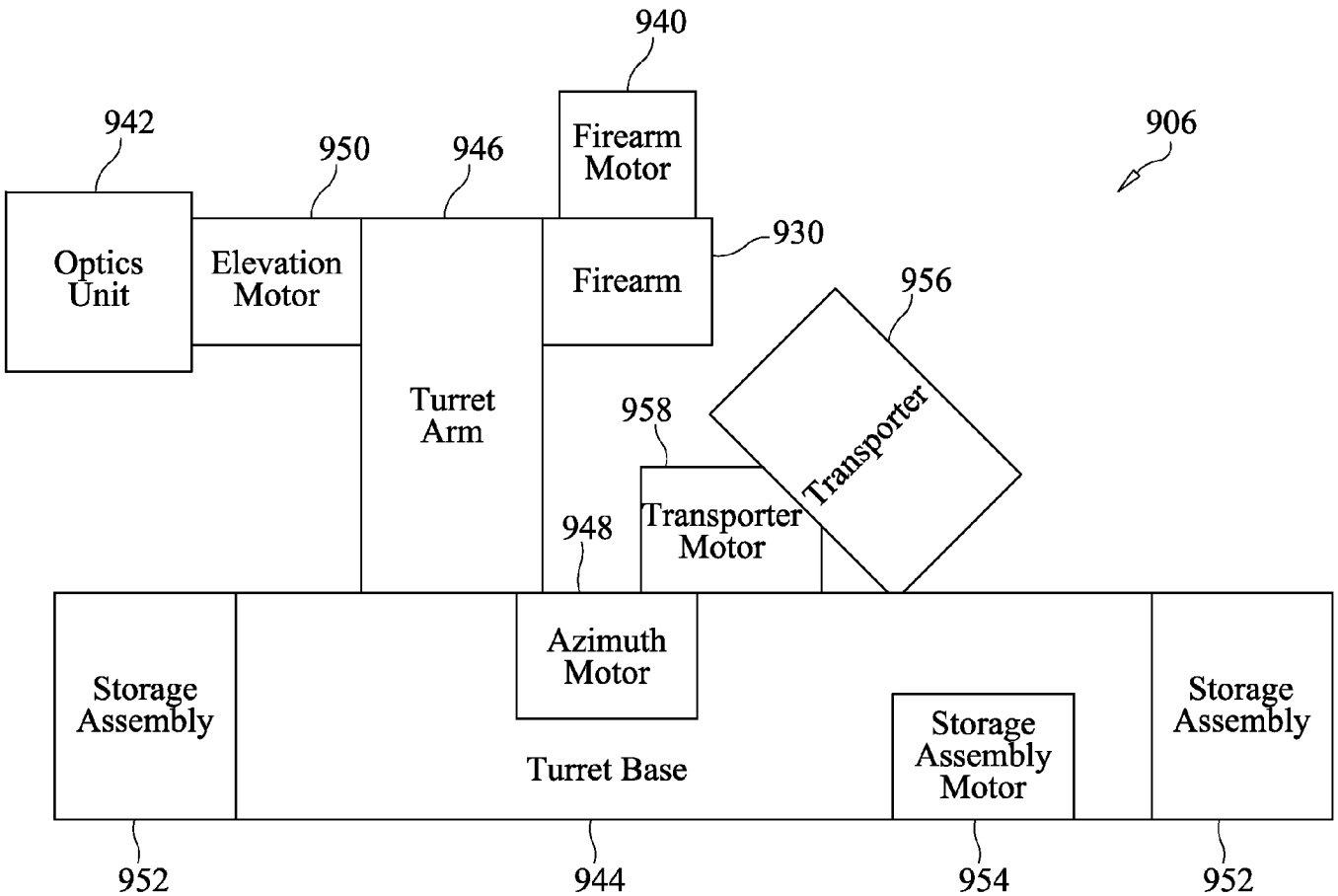
FIG. 21 is a schematic diagram of a portion of an embodiment of a weapon station.

FIG. 21 is a schematic diagram of a portion of an embodiment of a weapon station 906. The firearm mover 928 (FIG. 20) may include a turret base 944, a turret arm 946 that is rotatable with respect to the turret base 944, and an azimuth motor 948 for rotating the turret arm 946. The ammunition storage and transport system 926 (FIG. 20) may include a transporter 956 and a storage assembly 952. A transporter motor 958 may drive the transporter 956. A storage assembly motor 954 may drive the storage assembly 952. Storage assembly 952 may have, for example, a linear form or a circular form, such as a carousel. Firearm 930 may be mounted on turret arm 946. Motor 940 may supply the power for cycling firearm 930. An elevation motor 950 may adjust the angle of inclination of firearm 930. An optics unit 942 may be used for aiming the firearm 930.

Figure 22:
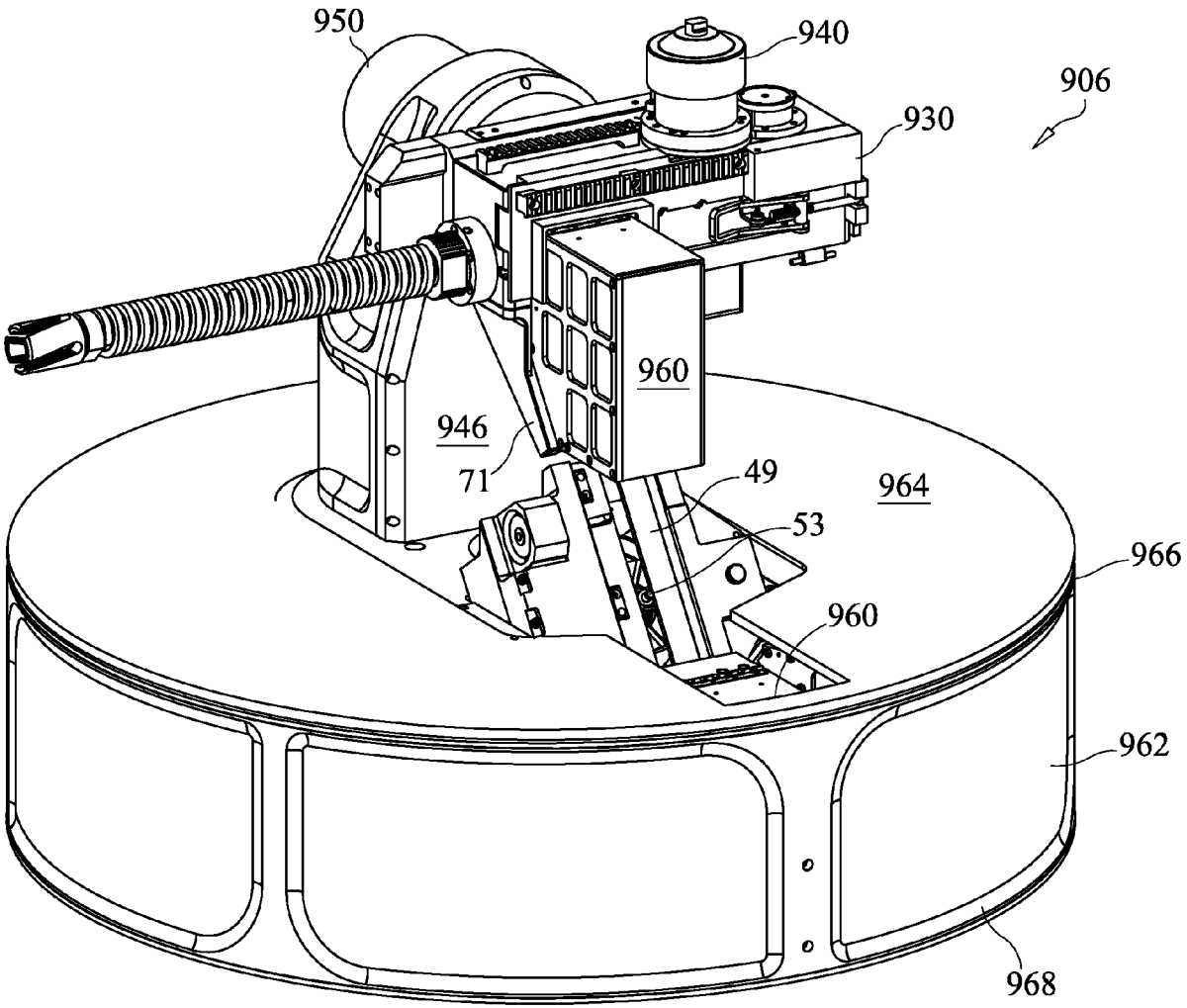
FIG. 22 is a perspective view of an embodiment of a weapon station.
Figure 23:
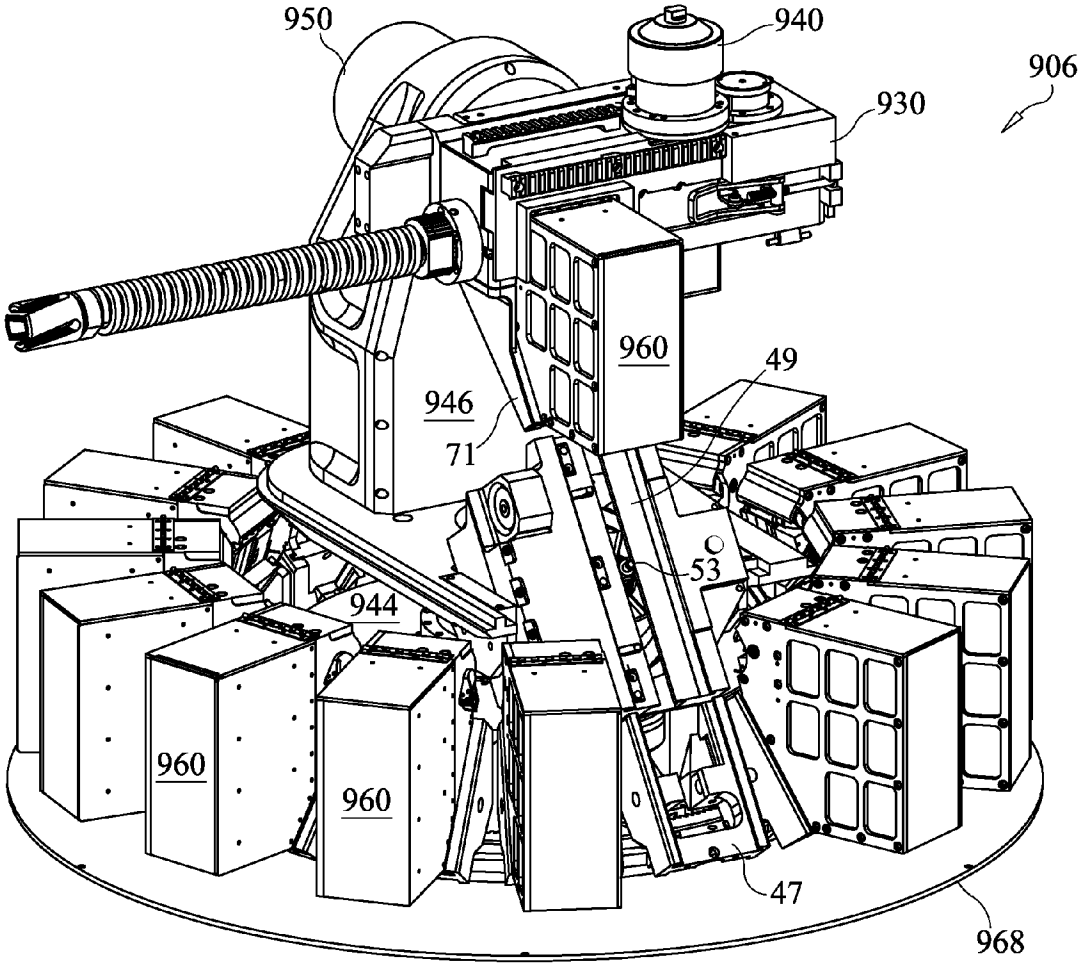
FIG. 23 is a partially cutaway, perspective view of the weapon station of FIG. 22.

FIG. 22 is a perspective view and FIG. 23 is a partially cutaway, perspective view of an embodiment of weapon station 906. The turret arm 946 may be rotatable with respect to the turret base 944 (FIG. 23). Firearm 930 may be fixed to turret arm 946. An elevation motor 950 may be disposed adjacent turret arm 946, for adjusting the angle of inclination of the firearm 930. A firearm driver or motor 940 may provide power for cycling the firearm 930. Firearm motor 940 may be, for example, a variable speed electric motor.

The transporter 956 may be, for example, transporter 1 (FIG. 3) or transporter 101 (FIGS. 16(*a*)-(*b*)). Transporter 956 may be disposed adjacent a track 49 on which ammunition containers 960 may be moved to and from firearm 930. Payload engager 53 may engage containers 960, as described with respect to payloads 43 (FIGS. 19(*a*)-(*b*)), 73 (FIG. 3), and 77 (FIGS. 16(*a*)-(*b*)). A use slot 71 for receiving ammunition containers 960 may be disposed adjacent firearm 930. Ammunition containers 960 may contain differing types of ammunition, for example, lethal rounds, non-lethal rounds, armor piercing rounds, rounds of various weight, rounds of various shapes, rounds with varying aerodynamic qualities, etc.

Storage assembly 952 may be, for example, storage assembly 45 (FIG. 1) and may include retention slots 47 for containers 960. A storage assembly side wall 962 may be fixed to a storage assembly base 968. Base 968 (with retention slots 47) may be rotated by motor 954 (FIG. 21). A lid 964 may be fixed for rotation with turret arm 946, and therefore, may rotate with respect to side wall 962 and base 968. A seal ring 966 may be disposed between the outer periphery of lid 964 and the upper edge of side wall 962.

Figure 24:
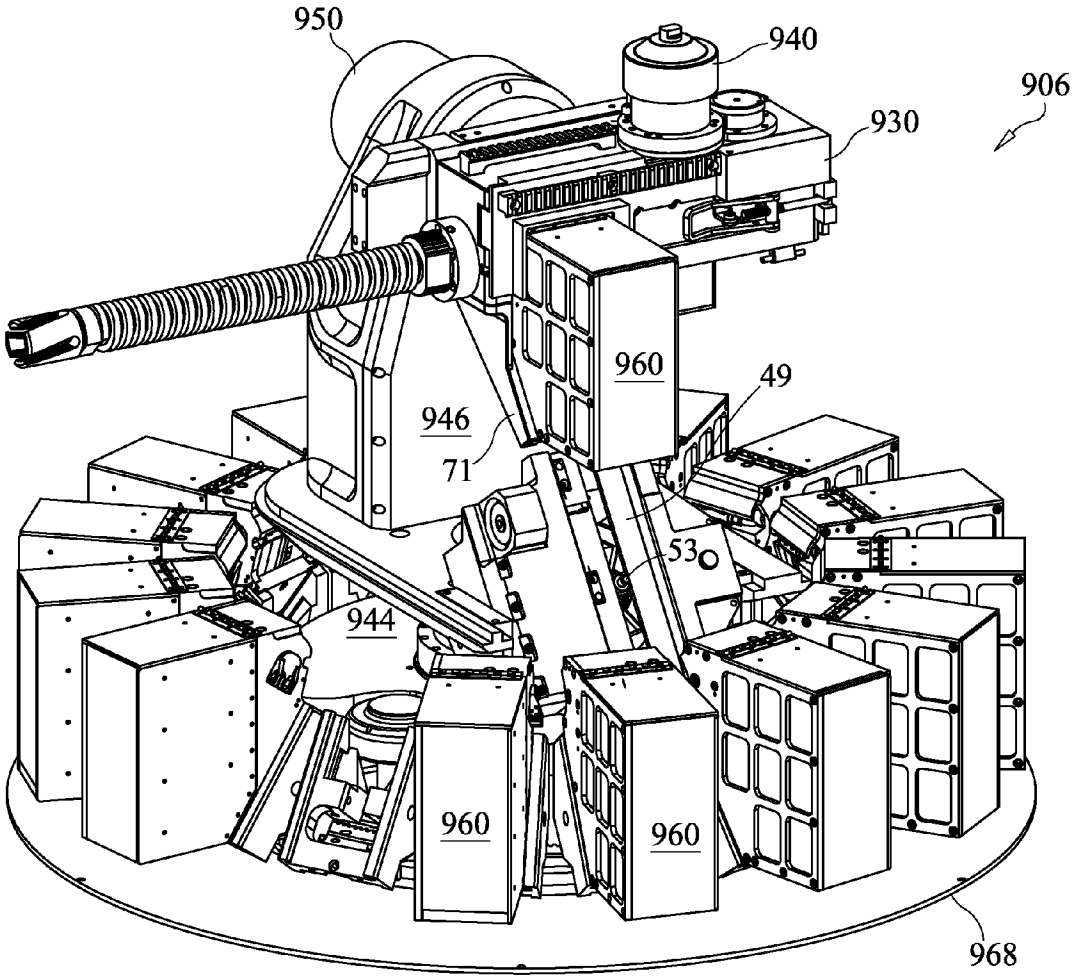
FIG. 24 is a partially cut away, perspective view of the weapon station of FIG. 23, wherein the storage assembly base is rotated about sixty degrees counter-clockwise from the position shown in FIG. 23.
Figure 25:
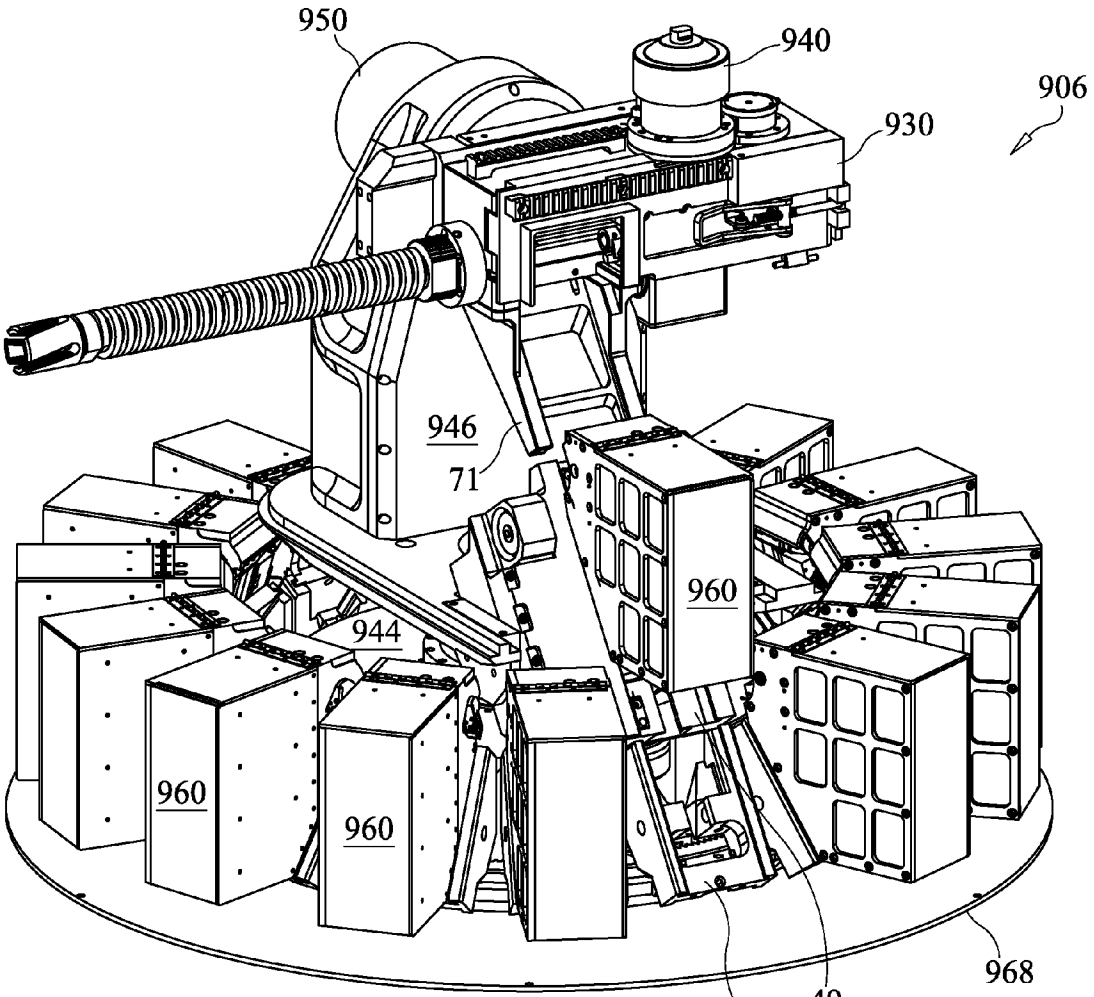
FIG. 25 is a partially cut away, perspective view of the weapon station of FIG. 23, wherein the ammunition container has been moved part way down the track, compared to the position in FIG. 23.
Figure 26:
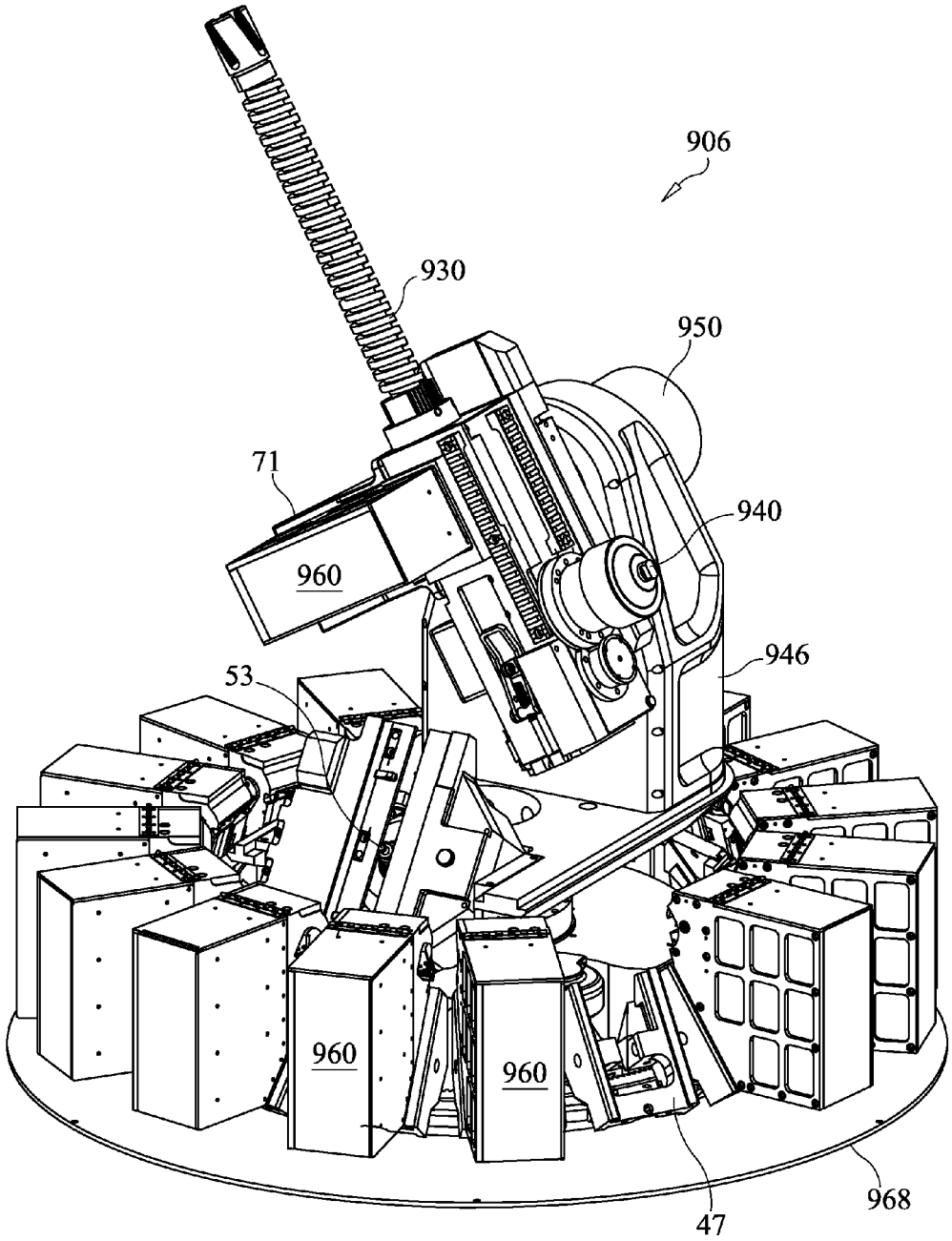
FIG. 26 is a partially cut away, perspective view of the weapon station of FIG. 23, wherein the firearm has been rotated about sixty degrees clockwise and elevated about sixty degrees upward, compared to the position shown in FIG. 23.

FIG. 24 is a partially cut away, perspective view of weapon station 906. In FIG. 24, the storage assembly base 968 and retention slots 47 have been rotated about sixty degrees counter-clockwise from the position shown in FIG. 23. FIG. 25 is a partially cut away, perspective view of weapon station 906. In FIG. 25, ammunition container 960 has been moved by transporter 956 part way down track 49, compared to the position in FIG. 23. FIG. 26 is a partially cut away, perspective view of weapon station 906. In FIG. 26, firearm 930 has been rotated about sixty degrees clockwise and elevated about sixty degrees upward, compared to the position shown in FIG. 23.

Referring to FIG. 20, weapon station 906 may be controlled by, for example, the computer 914, the controls 922, and the joystick 920 located at the operator station 902. The joystick 920 may be used, for example, to adjust the azimuth and elevation of firearm 930, to zoom and focus cameras located in optical unit 942 (FIG. 21), to operate a laser range finder located in optical unit 942, and to fire firearm 930. "Firing" firearm 930 means that the operating group of the firearm 930 is moved through a firing sequence by the motor 940. The joystick 920 may include a "dead-man" switch for disabling the firing function and the motion (azimuth and elevation) function.

The speed of movement of the operating group of firearm 930 may be varied by varying the speed of motor 940. In addition, various modes of fire may be selected, for example, a single-shot mode, a burst mode, an automatic mode, and a precision mode. In a precision mode, the operating group of firearm 930 may be cycled to a position just prior to "firing" and then stopped. Starting from this stopped position, only a very small movement of the operating group of the firearm 930 may be needed to fire a cartridge. Thus, any inaccuracy that may be caused by movement of components in the firearm 930 may be minimized by using the precision mode of firing.

To control the ammunition storage and transport system 926, the human user may not need to directly control each motor and actuator of the system 926. Rather, computers 914 and 924 may be programmed to initiate a specific set of actions in response to, for example, the push of a single button by the human user. In this way, the system 926 may be simple for a human user to operate.

Control devices, such as buttons, dials, switches, etc. in operator station 902 may be actual, physical buttons, dials, switches, etc, or, such controls may be implemented in a "virtual" manner by using a computer display touch screen and generating images of the various push buttons, dials, etc. directly on the touch screen.

Figure 27:
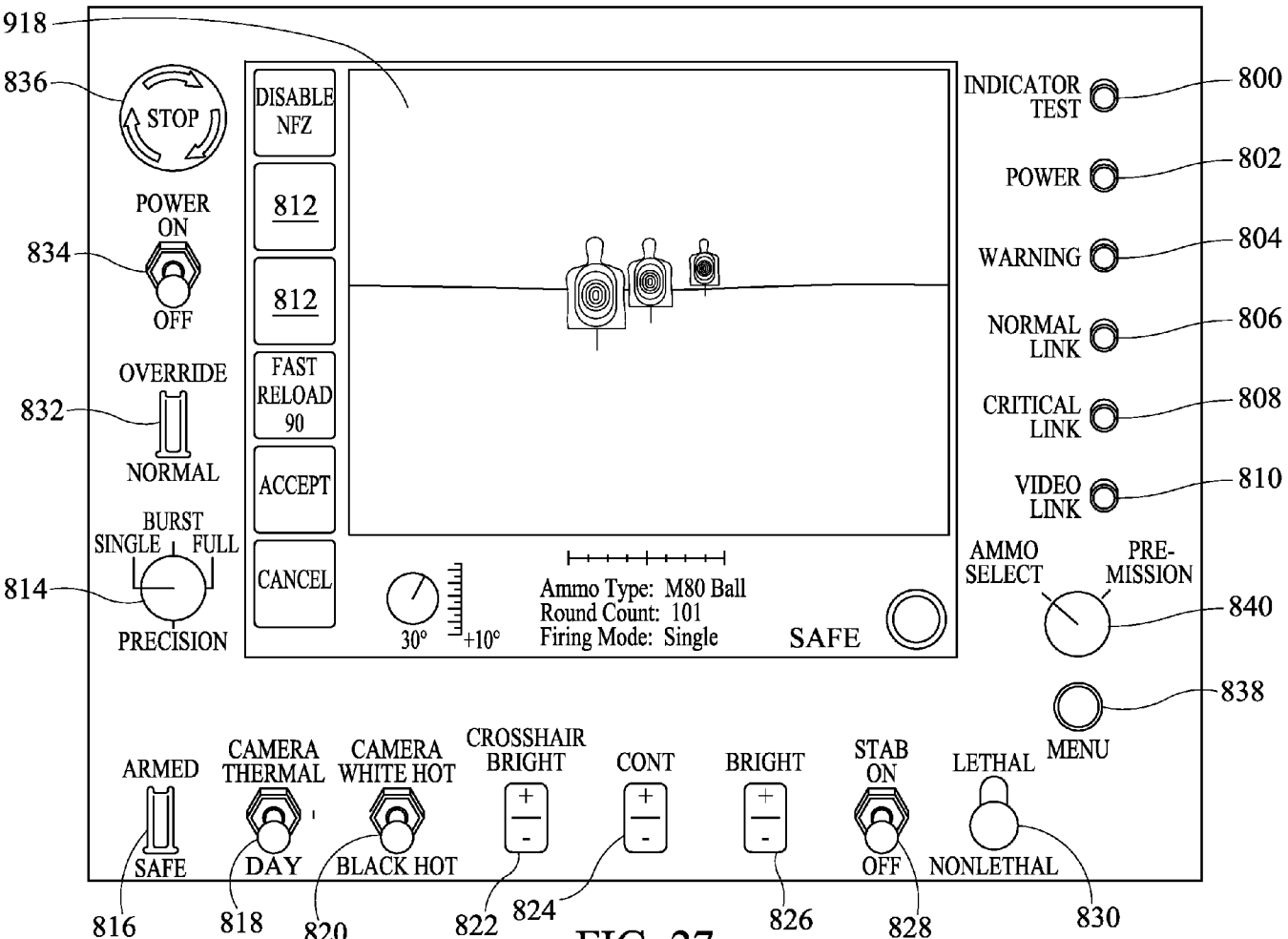
FIG. 27 is a schematic diagram of an exemplary graphical user interface and control panel.

FIG. 27 is a schematic diagram of an exemplary GUI 918 and additional controls and indicators 922. A plurality of indicator lamps 800-810 may be provided for indicating various states of the remotely-operable, automatically-reloadable weapon system 900. A majority of the area of the GUI 918 may be the image sensed by the optics unit 942 on the weapon station 906. This image may correspond to the aiming of the firearm 930. The GUI 918 may include a plurality of "virtual" buttons 812 that may vary, depending on the mode of the control system. The virtual buttons 812 may be used with a touch screen type of visual monitor so that touching a virtual button 812 causes an action to be performed. Virtual buttons 812 may also display information.

A firing mode selector knob 814 may allow the user to select between precision, single shot, a burst of shots, or fully automatic.

An armed/safe covered toggle switch 816 may default to the safe position when closed and may allow the user to arm the system. In the safe position, the firearm 930 may not fire. In the armed position, the firearm 930 may be enabled to fire.

A camera selection toggle switch 818 may allow the user to select either the day camera or the thermal camera in the optics unit 942. A thermal camera selection toggle switch 820 may allow the user to select either "white hot" or "black hot" for the thermal camera. The intensity of the reticules in the optics unit 942 may be adjusted by operating the crosshair bright switch 822.

A display contrast switch 824 may be used to adjust the contrast of the visual display 916. A display brightness switch 826 may be used to adjust the brightness of the visual display 916.

A stabilization toggle switch 828 may allow the user to turn on or off the system stabilization. System stabilization is an algorithm that may run on computer 924 (FIG. 20). The system stabilization algorithm may use data from sensors 935. Sensors 935 may measure rotational position and/or velocity of the firearm 930 in up to three different axes. Sensors 935 may also measure the rotational position and/or velocity of the turret base 944 in up to three different axes. Turret base 944 may be rigidly mounted to a moving vehicle, for example.

The system stabilization algorithm may use the measurements from sensors 935 to determine positions of firearm 930 in azimuth and elevation and/or velocities of firearm 930 in azimuth and elevation. The system stabilization algorithm may minimize the motion of the firearm 930 to assist the human operator in keeping the firearm 930 on the target. Motion commands for firearm 930 that originate from a human operator (via the joystick 920 or other means) may be summed with motion commands generated by the stabilization algorithm, and then applied to motors 934 that move firearm 930.

Another form of system stabilization may be also be used when the firearm 930 is fired from a moving platform. The range to the target provided by the laser range finder, data from the sensors 935, and data from sensors that may measure linear positions, velocities, and/or accelerations of the moving platform may be used in a separate algorithm. This algorithm may be run on computer 924 and may include ballistic corrections to minimize the distance from the center of a stationary target to the location where the rounds from firearm 930 actually impact.

Emergency stop button 836 may be used to quickly shut down the system 900 in the case of an emergency. Unlike simply disconnecting power, the stop button 836 may shut down the system 900 in a safe manner. First, the firearm 930 may cease firing, the transporter motor 958 (FIG. 21) may be powered off, and the storage assembly motor 954 (FIG. 21) may be powered off. Once the firearm 930 has ceased firing, the azimuth and elevation motors 948, 950 may also be turned off. The stop procedure initiated with button 836 may ensure that the operator retains control of the pointing direction of the firearm 930 during a system failure in which the firearm 930 may continue to fire even after the operator has commanded the firearm 930 to stop firing.

Figure 29:
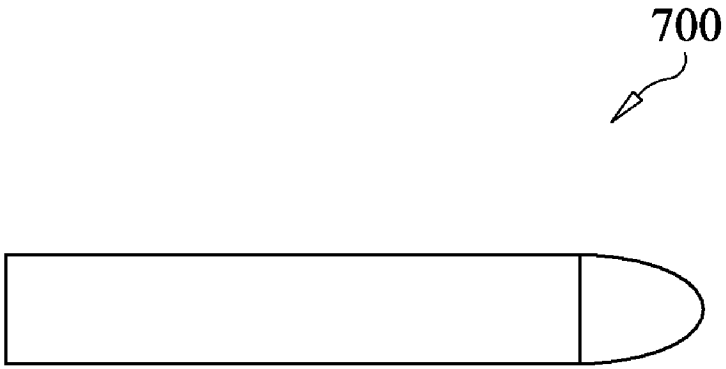
FIG. 29 shows a lethal cartridge.
Figure 30:
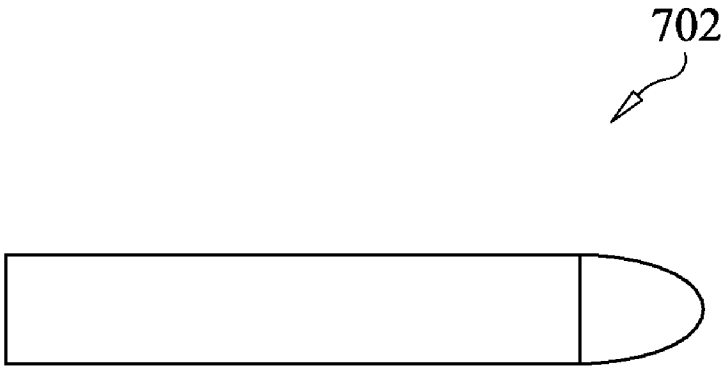
FIG. 30 shows a non-lethal cartridge.

A lethality toggle switch 830 may allow the user to switch between lethal and non-lethal ammunition. Putting the switch 830 in the lethal position may not allow non-lethal ammunition to be loaded or fired. With the switch 830 in the non-lethal position, lethal ammunition may not be able to be loaded or fired. If the wrong type of ammunition is loaded when the switch position is changed, the AMMUNITION SELECTION menu (FIG. 28) may be displayed, thereby allowing the user to change the active ammunition container 960 for one of the correlating ammunition type. FIG. 29 shows a lethal cartridge 700. FIG. 30 shows a non-lethal cartridge 702.

Figure 28:
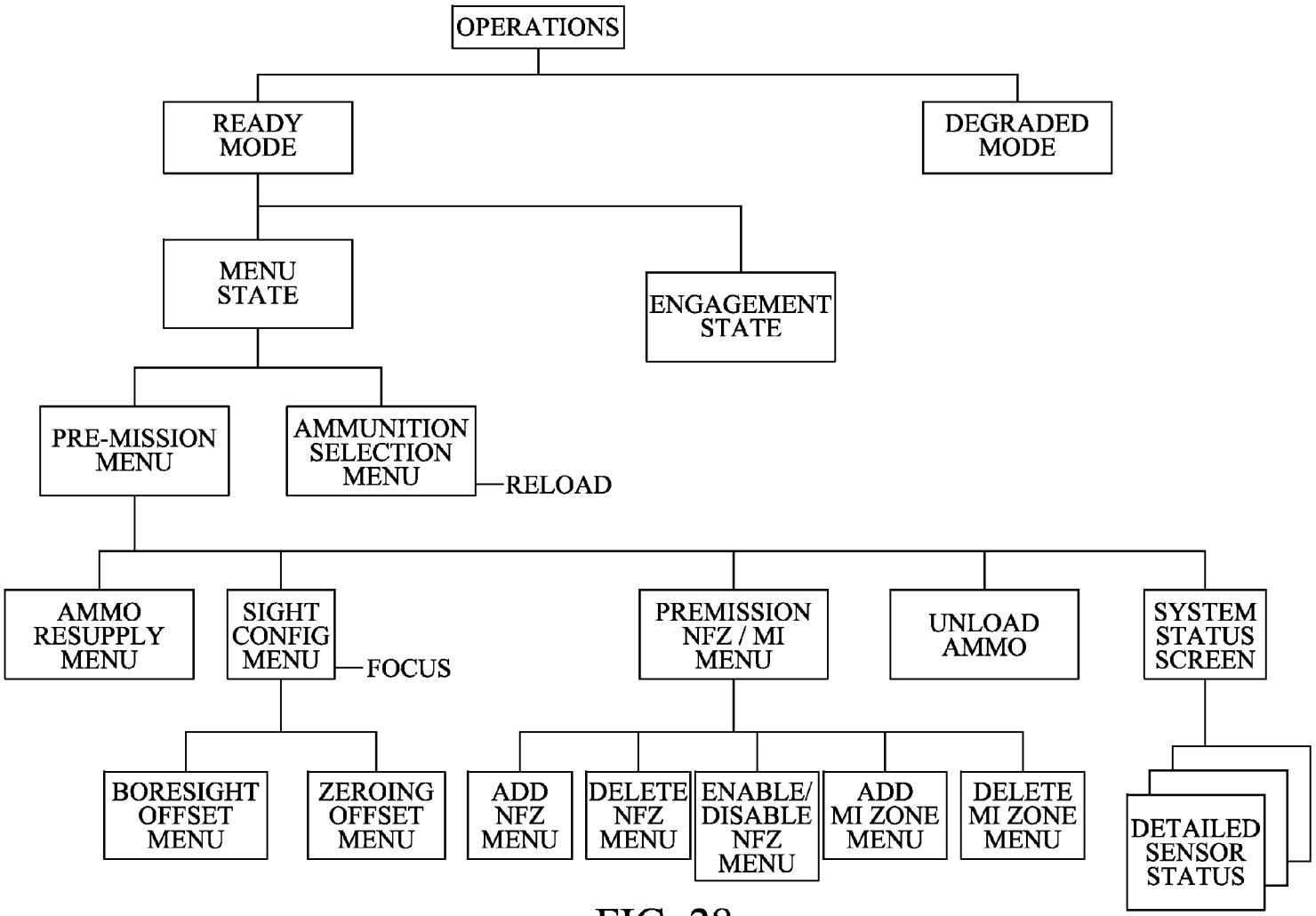
FIG. 28 is a flow chart showing an exemplary selection sequence for configuring and operating a remotely-operable, automatically-reloadable weapon system.

FIG. 28 is a flow chart showing an exemplary selection sequence for configuring and operating the remotely-operable, automatically-reloadable weapon system 900. In the DEGRADED mode, the weapon station 906 may not be fully operable, but some functionality may be available. In the READY mode, the user may choose an ENGAGEMENT mode or a MENU mode. The MENU mode may be used to configure the weapon station 906. The ENGAGEMENT mode may be used to fire the firearm 930.

To enter the ENGAGEMENT mode, the dead-man switch is "on" in the joystick 920 (FIG. 20). In the ENGAGEMENT mode, possible actions may include firing the firearm 930, moving the firearm 930, and controlling the optics unit 942. A "fast reload" action (initiated by pushing a virtual button 812) may be a single step to unload the active ammunition container 960 and load another ammunition container 960 having the most rounds of the same type of ammunition. The fast reload virtual button may indicate the maximum number of rounds in a single ammunition container 960 and the total number of rounds remaining for the currently active type of ammunition.

The selector knob 840 and the menu button 838 (FIG. 27) may provide access to the MENU mode. The dead-man switch must be inactive to enter the MENU mode. The selector knob 840 may be in any position desired, but while in ENGAGEMENT mode the touch screen may only operate when the dead-man switch is activated. ENGAGEMENT mode allows the operator to perform the normal operations necessary to carry out mission requirements. Activating the dead-man switch in any other mode will return the control unit to ENGAGEMENT mode.

The laser range finder may be actuated by pressing a "laze" button on the joystick 920. The laser range finder may then return a range to the target. Both the range and the range finder pointer may be displayed on the visual display 916 and may remain on-screen for ninety seconds, or until the return range value is accepted.

The remote weapon system 900 may allow the human operator to define one or more No Fire Zones (NFZ). The remote weapon system 900 may also have one or more preprogrammed NFZ. The NFZ may be activated (implemented), or deactivated (unimplemented). The NFZ may be defined by the volume inside four coordinate pairs, where each coordinate pair includes an elevation coordinate and an azimuth coordinate. When the firearm 930 is pointing into an activated NFZ, the computer 924 may prevent the firearm 930 from firing, regardless of commands from the human operator.

A NFZ may be further defined by adding a third coordinate, representing range, to each of the four coordinate pairs. In this case, the computer 924 may prevent the firearm 930 from firing, regardless of human commands, when the ballistically corrected aiming point falls inside the NFZ.

Each NFZ may also have a buffer zone surrounding it on all sides. The buffer zone may be defined as, for example, an area ten degrees above and below, and five degrees left and right of, the NFZ. When in the ENGAGEMENT or READY modes, if the firearm 930 is aimed within the buffer zone around an activated NFZ, a warning light 804 may blink and a graphical and/or text message warning the operator may appear in the video display 916.

In ENGAGEMENT mode, a "virtual" button 812 may be used to deactivate the NFZ until the buffer zone is exited. The deactivate action may be performed on all NFZs in which the firearm 930 is presently aimed. An emergency override switch 832 may allow the user to deactivate all of the NFZ.

During normal operations in the ENGAGEMENT mode, a warning message may be displayed if the ammunition count reaches twenty rounds. A "fast reload" virtual button may be available for selection. Once "fast reload" is selected, the system 900 may load a new ammunition container 960 with the most rounds of a similar ammunition type.

When the lethality switch 830 is set to a status that is different from the currently loaded ammunition, the system 900 may be forced to enter the AMMUNITION SELECTION menu. The ammunition that will be available for selection may be displayed in green and may correspond to the current position of the lethality switch 830. Selecting a new type of ammunition may cause unloading of the current ammunition container 960 and loading of a newly selected ammunition container 960, followed by a return of the system 900 to the READY mode.

The PRE-MISSION MENU or mode may be selected by placing the ammo select/pre-mission switch 840 in the pre-mission position and depressing the menu button 838. The armed/safe switch 816 must be in the safe position and the dead-man switch in the joystick 920 must be in the "off" position. Actions in the PRE-MISSION mode may include entering the AMMUNITION RESUPPLY MENU, entering the SIGHT CONFIGURATION MENU, entering the NO FIRE ZONE/MOTION INHIBIT SETUP MENU, entering the SYSTEM STATUS SCREEN, and entering UNLOAD AMMO.

Upon entrance to the PRE-MISSION MENU the AMMO RESUPPLY, SIGHT CONFIG, PRE-MISSION NFZ & MOTION INHIBIT, SYSTEM STATUS, and UNLOAD AMMO virtual buttons 812 may be available on the GUI 918. Upon selection of one of the menu options, the system 900 will enter the selected menu.

Depressing the UNLOAD AMMO button 812 may cause the system to remove the active ammunition container 960 from the firearm 930 weapon and return it to a storage assembly retention slot 47.

In the AMMO RESUPPLY mode, ammunition containers 960 may be loaded or unloaded from retention slots 47. Unknown ammunition containers 960 may be rejected and the user may be forced to remove them from the retention slot 47. Only one retention slot 47 may be accessed at a time. Upon entering the AMMO RESUPPLY mode, a visual image of all the retention slots 47 (for example, there may be fifteen slots 47) may be displayed on the GUI 918. For each retention slot 47, the slot number, ammunition lethality, ammunition type, and number of rounds may be displayed.

In the AMMO RESUPPLY mode, control may be transferred to a keypad located on the weapon station 906. A human operator may open the keypad panel at the weapon station 906 to lockout the operator station 902 and transfer control to the weapon station 906. If the keypad panel at the weapon station 906 is closed at any time other than when the operator is instructed to do so, the control will transfer back to the operator station 902. If an unknown ammunition container 960 is loaded in a retention slot 47, the keypad at the weapon station 906 may display a warning message.

In the SIGHT CONFIGURATION mode, the bore sight offsets and zeroing offsets may be set. Zeroing offsets must be repeated for each ammunition type. Zero offsets are ammunition specific. Zeroing offsets may be saved for the currently selected ammunition type.

In the PRE-MISSION NO FIRE ZONE/MI mode, one may add a new NFZ, delete a NFZ, activate or deactivate a NFZ, and add or delete a motion inhibit zone (MI). An MI is an area that the firearm 930 is prevented from entering. An MI may be defined, for example, when the firearm 930 is mounted on a vehicle, to prevent the barrel of the firearm 930 from contacting another piece of a equipment, such as an antenna or the main gun on a tank. An MI may be defined by the volume inside four coordinate pairs, where each coordinate pair includes an elevation coordinate and an azimuth coordinate. MIs may be entered by a human operator or pre-programmed into the computer 924. MIs may be overridden by a safety override switch.

In the SYSTEM STATUS SCREEN mode, one may view system status information and select detailed views of sensor information. Upon entrance to the SYSTEM STATUS SCREEN mode, the system status information may be displayed in list format. Each of the sensors 933, 935, 937 may have an indicator for "OK", "Degraded", and "Error", respectively. Each sensor 933, 935, 937 may be selected to obtain a display of the sensor's detailed information.

In the AMMUNITION SELECTION menu, one may select a different type of ammunition than is currently loaded. Only one type of ammunition may be selected at one time. Upon entrance to the AMMUNITION SELECTION menu, all available ammunition types may be displayed. The currently loaded ammunition may be selected as a default and shown as a depressed (lit) button 812. Once an ammunition selection is confirmed, the ammunition container 960 having the most rounds will be loaded into the firearm 930.

After the initial set-up, the remotely-operable, automatically-reloadable weapon system 900 provides complete remote operation of an externally-powered firearm 930. The ammunition storage and transport system 926 may reload the firearm 930 multiple times by switching the ammunition containers 960. The ammunition storage and transport system 926 may switch ammunition types, if desired. Because firearm 930 is externally-powered, a hostile party may have great difficulty in removing firearm 930 from weapon station 906 and using firearm 930 manually. A variable speed motor 940 may allow infinite adjustment of the firing rate of firearm 930.

The remotely-operable, automatically-reloadable weapon system has been described with reference to certain preferred embodiments. However, numerous changes, alterations and modifications to the described embodiments are possible without departing from the spirit and scope of the invention as defined in the appended claims, and equivalents thereof.

What is claimed is:

1. An automatically-reloadable, remotely-operated weapon system, comprising:

an operator station;

a weapon station located distant from the operator station, the weapon station including an externally-powered firearm, a firearm mover for adjusting an azimuth and an angle of inclination of the firearm, and an ammunition storage and transport system for automatically moving ammunition to and from the firearm; and communicators disposed at the operator station and the weapon station for exchanging information between the two stations;

wherein the ammunition storage and transport system includes a transporter, a track disposed adjacent the transporter, and a storage assembly disposed adjacent the transporter, the storage assembly including a plurality of ammunition containers for holding said ammunition, and a plurality of retention slots, each retention slot capable of holding an ammunition container, with at least one retention slot disposed at a first end of the track;

wherein the transporter and storage assembly may be positioned relative to one another, so that any one of the plurality of retention slots may selectably be disposed at the first end of the track, to enable loading and unloading of the ammunition containers from the storage assembly;

wherein the ammunition storage and transport system includes a use slot disposed at a second end of the track adjacent the firearm, the transporter being operable to move the ammunition containers along the track between the retention slot and the use slot, and vice versa;

wherein the transporter includes:

a stationary base;

a first arm assembly including a first gear coupled to the stationary base, an idler gear that meshes with the first gear, and a second gear that meshes with the idler gear, the first and second gear including parallel axes and a gear ratio of the first gear to the second gear being 2:1;

a driver for rotating the first arm assembly around the axis of the first gear;

a second arm assembly rigidly coupled to the second gear such that rotation of the second gear rotates the second arm assembly around the axis of the second gear, the second arm assembly including a third axis that is parallel to the axes of the first and second gears wherein a distance between the first gear axis and the second gear axis is a same distance as a distance between the second gear axis and the third axis; and a payload engager disposed at the third axis, for engaging and disengaging the ammunition containers;

whereby, if the first gear of the transporter is held stationary with respect to the stationary base during the operation of the transporter, and the first arm assembly and the included idler gear and second gear are rotated about the axis of the first gear by the driver, then the movement and rotation of the second gear and the second arm assembly will cause the payload engager disposed at the third axis of the second arm assembly to move in a linear path substantially parallel to the track, and in doing so, will move an ammunition container which has been engaged thereto, along the track in a linear path between the retention slot and the use slot adjacent the firearm, such that the ammunition container is aligned with and engages the firearm to allow transfer of the ammunition from the ammunition container to the firearm;

means for positioning the storage assembly, and its included retention slots, relative to the transporter, so that any one of the plurality of retention slots may selectably be disposed at the first end of the track.

2. The system of claim 1, further comprising a variable speed motor for cycling the externally-powered firearm.

3. The system of claim 1, wherein a first one of the ammunition containers contains ammunition that is different than ammunition in a second one of the ammunition containers.

4. The system of claim 3, wherein the ammunition in the first container is lethal and the ammunition in the second container is non-lethal.

5. The system of claim 1, wherein the transporter includes a solenoid for actuating the payload engager.

6. The system of claim 5, wherein the payload engager comprises a pin.

7. The system of claim 1, wherein the first gear is rigidly coupled to, and stationary with respect to, the stationary base.

8. The system of claim 1, wherein:

the first gear is rotatable with respect to the stationary baser;

the transporter includes an actuator for rotating the first gear;

the actuator's rotation of the first gear moves the second arm assembly independently of movement of the first arm assembly;

the payload engager moves laterally with respect to a linear path along the track, to engage and disengage the ammunition containers.

9. The system of claim 1, wherein the transporter includes a stop mechanism disposed adjacent the track and operable to retain an ammunition container in a position between ends of the track.

10. The system of claim 9, wherein the stop mechanism includes at least one support, the ammunition container bearing against the support in the retained position.

11. The system of claim 9, wherein the transporter includes a solenoid for actuating the stop mechanism.

12. The system of claim 1, wherein the firearm mover includes a turret base, a turret arm, an azimuth motor for rotating the turret arm with respect to the turret base, and an elevation motor for adjusting the angle of inclination of the firearm.

13. The system of claim 12, further comprising an optics unit for sighting the firearm.

14. A method, comprising:

providing the system of claim 1; and automatically reloading the firearm by moving a first ammunition container away from the firearm to a first retention slot positioning the storage assembly, and its included retention slots, relative to the transporter so that a second retention slot is disposed at the first end of the track, and moving a second ammunition container adjacent the firearm.

* * * * *